United States Patent [19]

Crutcher et al.

[11] Patent Number: 4,964,558

[45] Date of Patent: Oct. 23, 1990

[54] ELECTRO-MECHANICAL FASTENER DRIVING TOOL

[75] Inventors: John P. Crutcher; J. Charles Hueil, both of Cincinnati; Donald D. Juska, Winchester, all of Ohio

[73] Assignee: Sencorp, Cincinnati, Ohio

[21] Appl. No.: 358,656

[22] Filed: May 26, 1989

[51] Int. Cl.[5] ..... B25C 1/06

[52] U.S. Cl. ..... 227/8; 227/131; 173/13; 173/53; 173/124

[58] Field of Search ..... 227/8, 121, 124, 131, 227/134, 146–147; 173/13, 53, 124, 139

[56] References Cited

U.S. PATENT DOCUMENTS

| | | | |
|---|---|---|---|
| 4,042,036 | 8/1977 | Smith et al. | 227/131 X |
| 4,121,745 | 10/1978 | Smith et al. | 227/131 X |
| 4,189,080 | 2/1980 | Smith et al. | 227/131 X |
| 4,204,622 | 5/1980 | Smith et al. | 227/131 X |
| 4,298,072 | 11/1981 | Baker et al. | 227/131 X |
| 4,323,127 | 4/1982 | Cunningham | 227/8 X |
| 4,721,170 | 1/1988 | Rees | 227/8 X |
| 4,767,043 | 8/1988 | Canlas, Jr. | 227/8 |

*Primary Examiner*—Frank T. Yost
*Assistant Examiner*—Rinaldi Rada
*Attorney, Agent, or Firm*—Frost & Jacobs

[57] ABSTRACT

An electromechanical flywheel containing fastener driving tool. The tool comprises a frame supporting a housing, a guide body and a fastener containing magazine. A free floating driver within said frame. Forward and rearward flywheels are arranged in tandem within the tool frame with their peripheral surfaces opposed. A pair of beam-like arcuate load springs are located to either side of the frame. The load spring rearward ends carry bearings in which the shaft of the rearward flywheel is journaled. The load spring forward ends carry rotatable eccentric bearing housings in which the shaft of the forward flywheel is journaled. The bearing housings are rotatable to shift the forward flywheel between operative and inoperative positions wherein the opposed surfaces of the flywheels are spaced by a distance less than and a distance greater than the thickness of the driver, respectively. The load springs permit the forward flywheel to yield slightly from its operative position when the driver is introduced between the flywheels. An electric motor and gear train drive the flywheels in counterrotation regardless of the position of the forward flywheel. A driver return system comprises a stationary idler roller and a return roller and gear train constantly driven by the rearward flywheel and pivotable thereabout between operative and inoperative positions. The driver is shiftable between a retracted position and an extended position. A driver trigger released locking means maintains the driver in its normal position. A driver actuator introduces the released driver between the flywheels. The tool has a safety which controls the driver trigger, the driver actuator and the positions of the forward flywheel and the return roller.

39 Claims, 17 Drawing Sheets

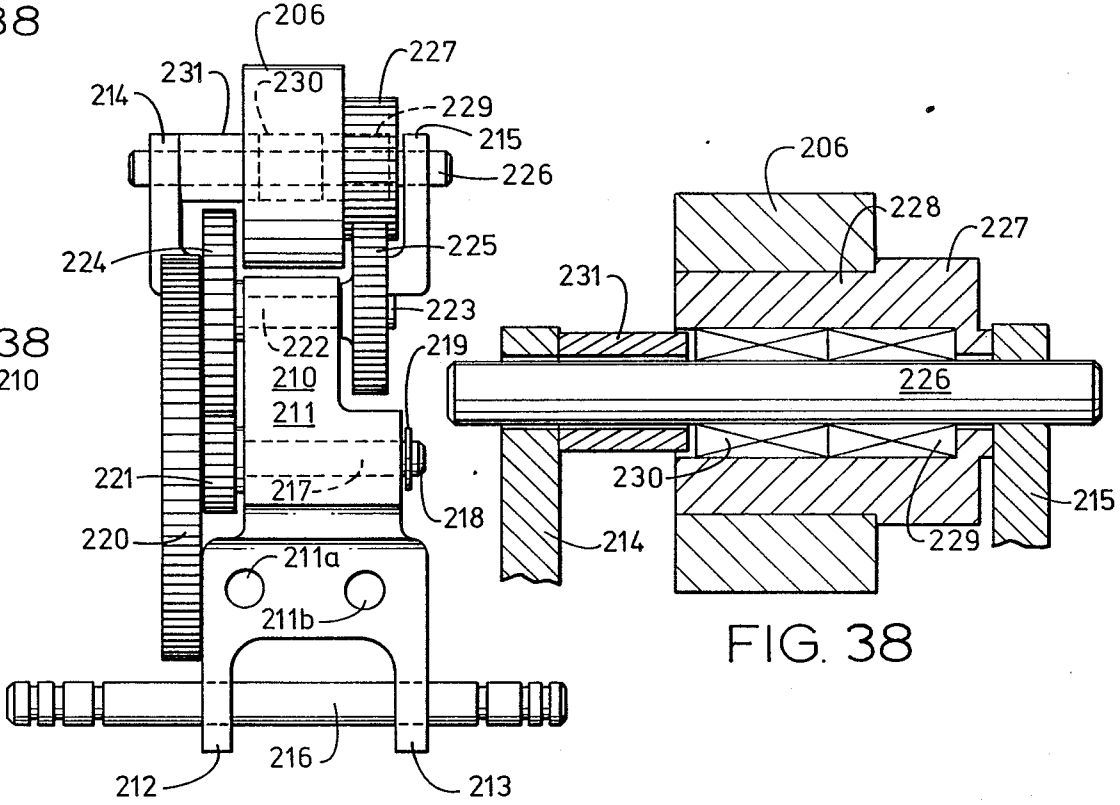
FIG. 38
FIG. 36
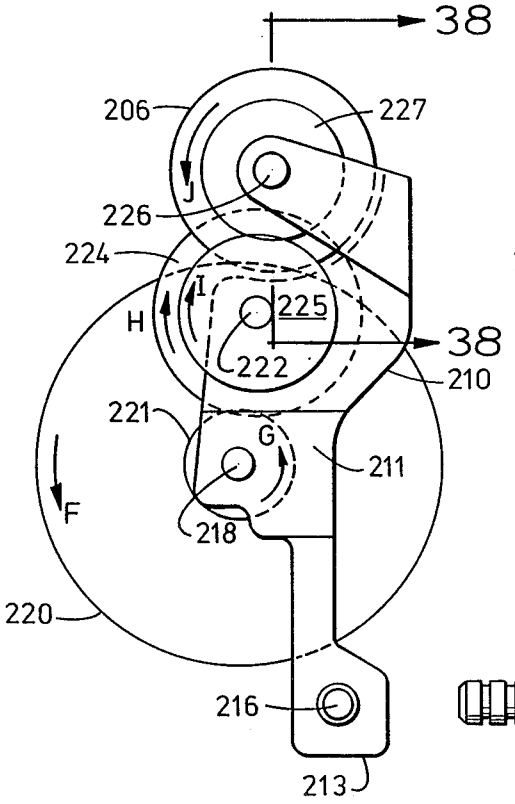
FIG. 37

ELECTRO-MECHANICAL FASTENER DRIVING TOOL

TECHNICAL FIELD

The invention relates to a fastener driving tool employing a pair of counter-rotating flywheels and a free floating driver, and more particularly to such a fastener driving tool with an improved flywheel mounting assembly, an improved flywheel drive assembly and an improved driver return assembly.

BACKGROUND ART

With appropriate modifications to the magazine, the guide body (for guiding the driver and the fastener being driven) and the configuration of the driver, well within the skill of the worker in the art, the tool of the present invention can be used to drive various types of fasteners inclusive of nails, staples, clamp nails and the like. While not intended to be so limited, for purposes of an exemplary showing the tool of the present invention will be described in its application to the driving of nails.

Prior art workers have devised many types of manually operated fastener driving tools utilizing driving means actuated pneumatically, electro-mechanically or by internal combustion. To date, pneumatically actuated fastener driving tools are the ones most frequently encountered. While pneumatically actuated tools work well and have become quite sophisticated, they nevertheless require the presence of a compressor or the like.

There are many job sites where a source of compressed air is not normally present. This is particularly true of smaller job sites and the like. On the other hand, electricity is almost always present on such sites. As a consequence, particularly in recent years, prior art workers have directed considerable attention to electro-mechanical tools.

Some prior art electro-mechanical tools depend upon a heavy duty solenoid to do the fastener driving. In general, however, such tools are not adequate where large driving forces are required or desired. As a consequence, prior art workers have also expended considerable thought and effort in the development of electro-mechanical fastener driving tools employing one or more flywheels. Examples of such tools are taught in U.S. Pat. Nos. 4,042,036; 4,121,745; 4,204,622; and 4,298,072. Yet another example is taught in British Pat. No. 2,000 716.

It will be evident from these patents that prior art workers have devoted a great deal of time to the development of flywheel fastener driving tools. Nevertheless, such tools do present their own unique problems. For example, in tools utilizing two flywheels, it has been the practice to provide a separate electric motor for each flywheel. This adds considerably to the weight and bulk of the tool and is difficult to synchronize. Another approach is to mount one of the flywheels on the electric motor shaft and then drive the second flywheel through a series of belts or chains and pulleys. Such drives are complex, difficult to adjust and were subject to wear.

Another problem area involved means to cause one of the flywheels to move toward and away from the other. Preferably, for example, one of the flywheels is capable of shifting toward the other and into an operative position wherein its periphery is spaced from that of the stationary flywheel by a distance less than the nominal thickness of the thickest part of the driver. The same flywheel is shiftable in the opposite direction to an inoperative position wherein its periphery is spaced from that of the fixed flywheel by a distance greater than the greatest nominal thickness of the driver. Heretofore, systems to bring about this shifting of one of the flywheels with respect to the other have been cumbersome, complex and not altogether satisfactory.

Yet another area of concern has involved means for returning the driver at the end of the drive stroke to its normal, retracted position. For these purposes, prior art workers have developed complex systems of springs, pulleys and elastomeric cords. Such systems, however, have proven to be subject to wear, stretching and deterioration due to lubricants and foreign materials within the tool housing.

The present invention cures these and a number of other problems normally encountered with a flywheel tool. The flywheels are provided with a unique mounting assembly involving the use of two plate-like springs and a pair of rotatable, eccentric bearing housings. The tool of the present invention utilizes a single electric motor. So long as the electric motor is energized, the flywheels are constantly rotated in opposite directions by a gear train, regardless of the relative positions of the flywheels with respect to each other. The driver is free floating. At the end of the workstroke the driver is engaged between a powered return roller and an idler roller and is shifted through a return stroke to its normal, uppermost position, in which position it is engaged and locked until released for the next drive stroke. Other improvements include a unique driver actuator for introducing the driver between the flywheels at the initiation of a drive stroke, and means assuring that the various events in a cycle of operation of the tool can take place only in the proper sequence.

DISCLOSURE OF THE INVENTION

In accordance with the invention there is provided a fastener driving tool employing a pair of counter-rotating flywheels and a floating driver. The fastener driving tool comprises right and left frame members which are joined together in parallel spaced relationship. All of the major remaining components are mounted on or between and supported by the frame members, including the housing 2, itself.

A forward flywheel and a rearward flywheel are arranged in tandem with their peripheral edges opposed. An arcuate, beam-like load spring is located on either side of the frame assembly. The rearward ends of the load springs carry bearings which are mounted in holes in the frame assembly and which carry the shaft of the rearward flywheel. The forward ends of the load springs rotatively mount bearing housings which are partially received within notches in the forward edges of the frame assembly. The shaft of the forward flywheel is rotatively mounted in the bearing housings. Rotation of the bearing housings will cause the forward flywheel to shift between an inoperative position wherein its peripheral surface is separated from the peripheral surface of the rearward flywheel by a distance greater than the greatest nominal thickness of the driver, and an operative position wherein the peripheral surface of the forward flywheel is spaced from the peripheral surface of the rearward flywheel by a distance slightly less than the greatest nominal thickness of the driver. When the forward flywheel is in its operative position and the driver is introduced between the flywheels, the forward flywheel is capable of yielding slightly, through the agency of the load springs.

The tool is provided with a single electric motor which is operatively connected to the flywheels by a gear train in such a way that the flywheels are rotated in opposite directions whenever the motor is energized and regardless of whether the forward flywheel is in its operative position or its inoperative position.

The tool is provided with a driver return system for shifting the free floating driver through a return stroke, following a workstroke. The return system comprises a stationary idler roller and a driven return roller. The driven return roller is shiftable between an inoperative position in which it is spaced from the fixed roller by a distance greater than the greatest nominal thickness of the driver and an operative position wherein it engages the driver between itself and the idler roller to initiate the return stroke. The driven return roller is operatively connected to the electric motor through a gear train such that the return roller is driven whenever the electric motor is energized, regardless of whether the driven return roller is in its operative or inoperative position. The tool is provided with a pair of driver locking members which engage the driver at the end of its return stroke and maintain it in its uppermost inactive position. The driver remains in this position until released by the driver locking members at the beginning of a workstroke. Release of the driver by the driver locking members is accomplished by a manual driver trigger.

The tool is provided with a driver actuator which forces the driver between the flywheels when the forward flywheel is in its operative position at the beginning of a work stroke. The driver actuator introduces the driver between the flywheels upon release of the driver by the driver locking members. The driver actuator is provided with a compression spring which, when compressed, urges the driver actuator downwardly against the upper end of the driver.

Finally, the fastener driving tool is provided with a workpiece responsive safety. The workpiece responsive safety, when pressed against a workpiece, is shiftable from a normal downwardly extending, unactuated position to an upwardly extending, actuated position. The workpiece responsive safety is spring biased to its unactuated position. When in its actuated position, the workpiece responsive safety enables the manual driver trigger, compresses the driver actuator spring, shifts the forward flywheel to its operative position and shifts the driven return roller to its inoperative position. When the workpiece responsive trip is in its normal, extended position, it disables the manual driver trigger, releases the driver actuator spring, shifts the forwardmost flywheel to its inoperative position and shifts the driven return roller to its operative position.

BRIEF DESCRIPTION OF THE DRAWINGS

FIG. 36 is a plan view of the driver return assembly.

FIG. 37 is a side elevational view of the structure of FIG. 36.

FIG. 38 is a fragmentary, enlarged, cross-sectional view taken along section line 38—38 of FIG. 37.

DETAILED DESCRIPTION OF THE INVENTION

Figure 1:
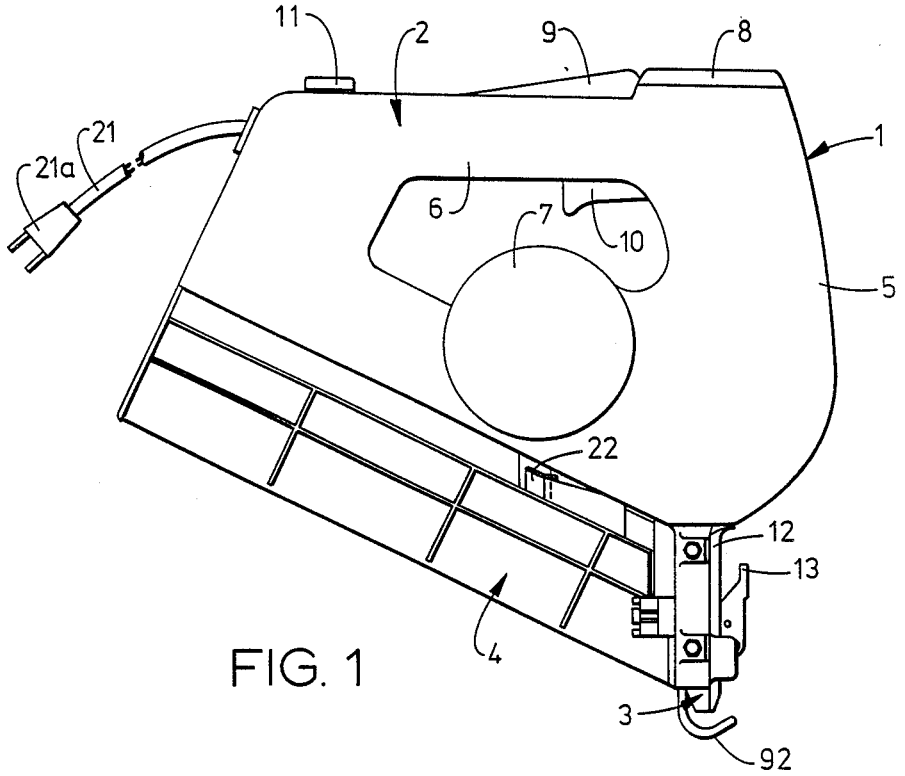
FIG. 1 is a fragmentary elevational view of an exemplary fastener driving tool of the present invention.

An exemplary embodiment of the fastener driving tool of the present invention is illustrated in FIG. 1. The tool is generally indicated at 1 and comprises a body generally indicated at 2, a guide body generally indicated at 3 and a fastener containing magazine generally indicated at 4.

The body 2 has a main portion 5 and a handle portion 6. The main body portion 5 incorporates a compartment 7 for an electric motor and a removable cap member 8. The housing 2 is preferably made in two halves **2*a* and 2*b* (see FIG. 6**) and can be molded of lightweight metal, plastic or the like.

The tool 1 is further provided with a motor actuating switch 9, a driver actuating trigger 10, and a motor speed control knob 11.

The guide body 3 provides a drive track **3*a* for the tool driver (to be described hereinafter) and for the nails within magazine 4. The guide body 3 may be provided with a front plate or door 12 and a locking lever 13 therefor, as is known in the art. The door 12 provides access to the drive track within the guide body 3**, should a nail become jammed therein.

Figure 2:
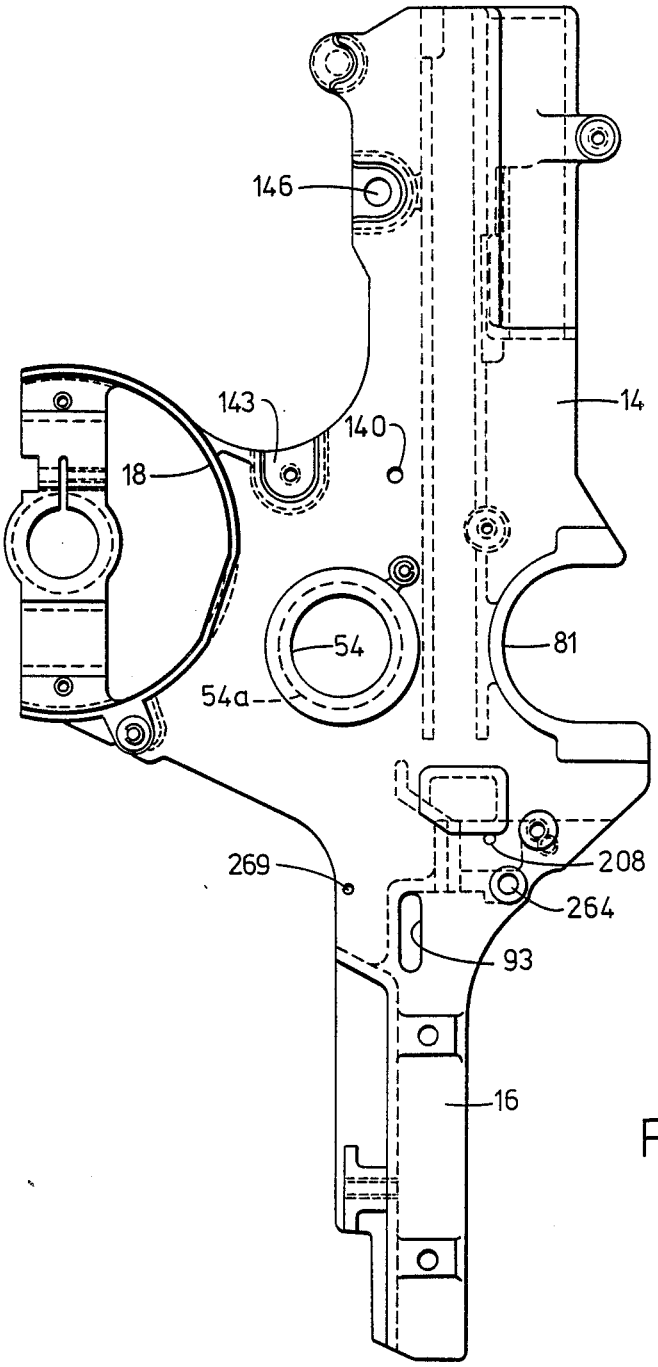
FIG. 2 is an elevational view of the right frame.
Figure 3:
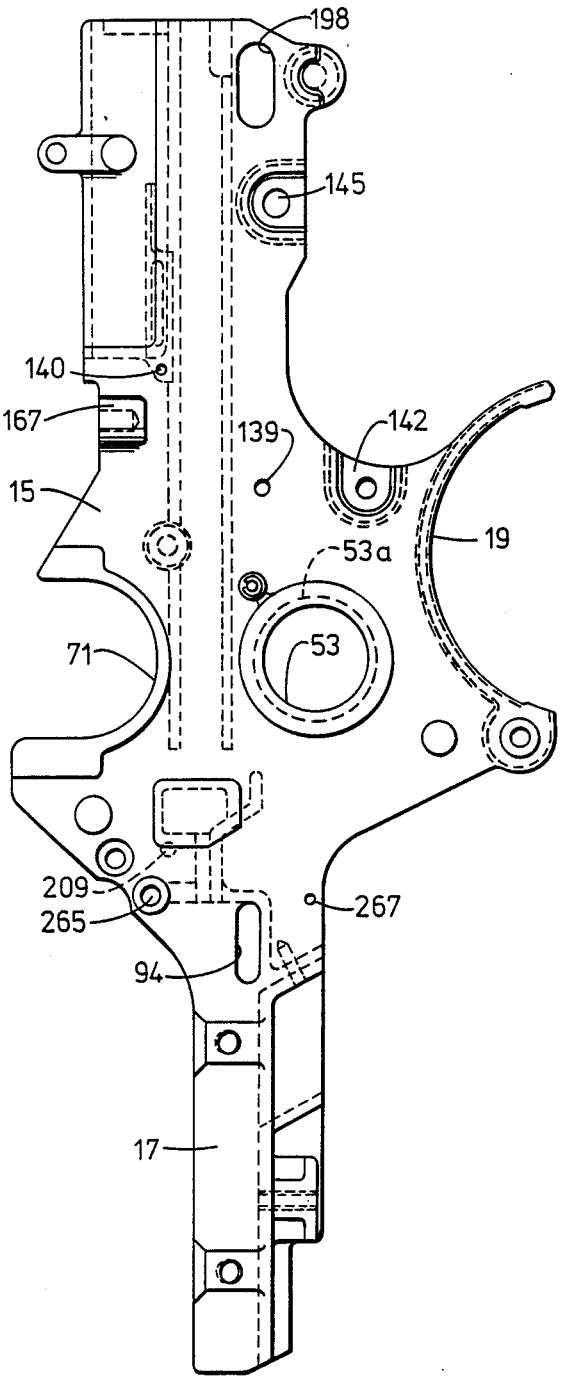
FIG. 3 is an elevational view of the left frame.

Reference is now made to FIGS. 2 and 3. FIGS. 2 and 3 illustrate, respectively, the outside surfaces of the right frame member 14 of the tool and the left frame member 15 of the tool. While the frame members 14 and 15 differ from each other in certain details, as will be apparent hereinafter, they are basically mirror images of each other and are intended to be bolted together. The inside surfaces of the frame members 14 and 15 have cooperating bosses and lugs which abut each other when the frames are assembled and maintain the frames 14 and 15 in parallel spaced relationship as is shown, for example, in FIG. 6. The lower portion 16 of right frame 14 and the lower portion 17 of left frame 15 (see FIGS. 2 and 3) cooperate to support the guide body 3. Gate 12 and locking lever 13 are affixed to the guide body. Magazine 4 is bolted or otherwise appropriately affixed to the lower portions 16 and 17 of frames 14 and 15.

The rearward portions of right frame 14 and left frame 15 are arcuately configured, as at 18 and 19, respectively. The arcuate frame portions 18 and 19 constitute mounts for an electric motor 20 shown in FIGS. 4–9. The electric motor 20 is connectable to a source of electricity by conventional electric cord 21 and connector or plug **21*a* (see FIG. 1). As indicated above, the motor is turned on and off by manual switch actuator 9 and may be provided with a conventional speed control 11**.

Figure 9:
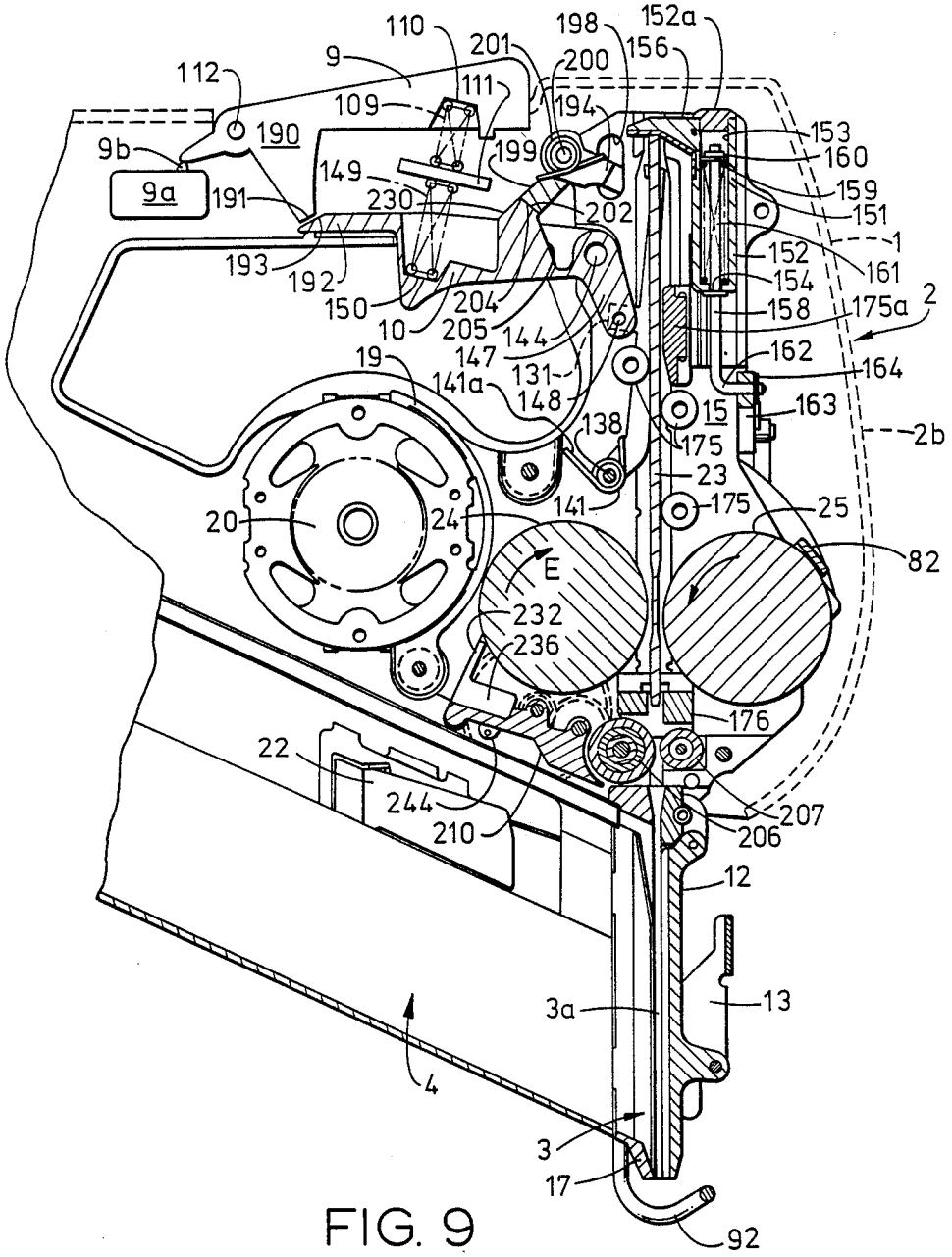
FIG. 9 is a fragmentary right side elevational view of the tool of the present invention, partly in cross section.

Turning to FIG. 9, the magazine 4 is conventional and is adapted to contain a tandem row of nails. The nails may be arranged in "sticks" whereby a plurality of nails are maintained in a tandem row by wire means, tape means, or the like, as is well-known in the art.

The magazine 4 is provided with a conventional feeder shoe 22 which is spring biased in such a way that it constantly urges the row of nails toward guide body 3 and the forwardmost nail of the row into the drive track **3*a* of guide body 3**.

The tool 1 has an elongated blade-like driver 23 for driving a nail in the drive track **3*a* into a workpiece (not shown). As will be more fully explained hereinafter, the tool 1 is provided with a rearward flywheel 24 and a forward flywheel 25. The flywheels 24 and 25 are counter-rotating and are actuated by electric motor 20** through a series of gears to be described hereinafter.

Figure 10:
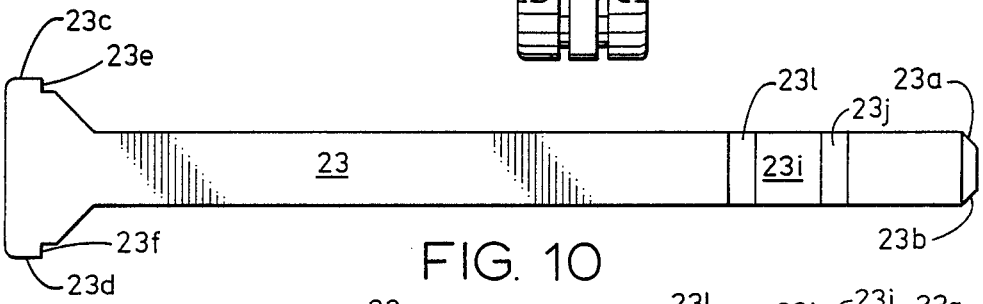
FIG. 10 is a front elevational view of the tool driver.
Figure 11:
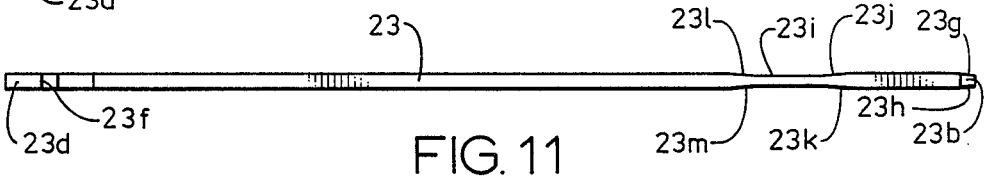
FIG. 11 is a side elevational view of the tool driver.

The driver 23 is illustrated in FIGS. 10 and 11. Driver 23 comprises an elongated blade-like member of uniform width and thickness throughout most of its length. length. Its lower end as viewed in FIG. 9 is to the right in FIGS. 10 and 11, and its upper end is to the left. The only deviations in width occur at both of its ends. At its lower end, the driver is relieved as at **23*a* and 22*b*. At its upper end, the driver is provided with laterally extending arms 23*c* and 23*d* forming shoulders 23*e* and 23*f*. Shoulders 23*e* and 23*f*** are of importance and their purpose will be described hereinafter.

As is apparent from FIG. 11, the lowermost end of driver 23 is slightly tapered on both sides at **23*g* and 23*h*. A short segment 23*i* of the driver is of a thickness approaching about half the nominal thickness of the remainder of the driver. At its lower end, the segment 23*i* is provided with ramps 23*j* and 23*k* and at its upper end, the segment 23*i* is provided with ramps 23*l* and 23*m***.

In an exemplary embodiment of the driver 23, the driver had an overall length of approximately six and one-half inches. The nominal thickness of the driver was about 0.095 inch. The length of segment **23*i* was about 0.450 inch and had a thickness of about 0.054 inch. In FIG. 9, the driver 23 is shown in its normal, fully retracted position and it will be noted that segment 23*i* lies directly between the flywheels 24 and 25**. The reason for this will be apparent hereinafter.

Figure 12:
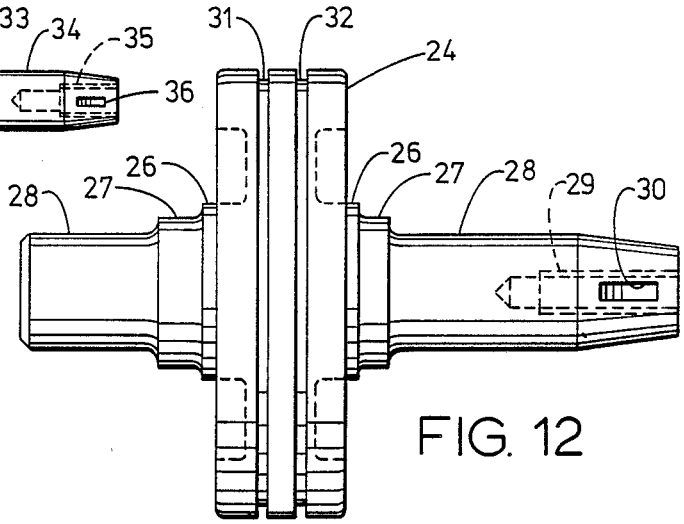
FIG. 12 is an elevational view of the rearward flywheel.

The rearward flywheel 24 is illustrated in FIG. 12. The rearward flywheel 24 has a central hub 26, a transition portion 27 and a shaft 28. It will be noted that the shaft 28 to the left of flywheel 24 is relatively short and of constant diameter. The shaft 28 to the right of flywheel 24 is longer and is slightly tapered at its free end. The righthand end of shaft 28 is provided with a threaded axial bore 29 and a key slot 30, the purposes of which will be apparent hereinafter.

Flywheel 24 may be provided with circumferential grooves, two of which are shown at 31 and 32. As is taught in U.S. Pat. No. 4,519,535 the grooves 31 and 32 provide voids along the traveling driver-flywheel contact line into which foreign material on the driver and flywheel can flow to prevent build-up of such foreign material at the driver-flywheel contact area sufficient to result in loss of friction therebetween. It is within the scope of the invention to provide circumferential grooves of the type taught in copending application Ser. No. 07/257,681, filed Oct. 14, 1988 in the names of Robert B. Houck and Arnold L. McGuffey, and entitled IMPROVED FLYWHEEL FOR AN ELECTRO-MECHANICAL FASTENER DRIVING TOOL. This copending application teaches grooves which extend both circumferentially of the workface and from side-to-side of the workface of the flywheel to provide a wiping action for the removal of foreign material.

Figure 13:
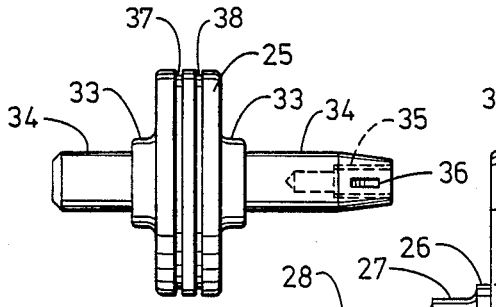
FIG. 13 is an elevational view of the forward flywheel.

The front flywheel 25 is illustrated in FIG. 13 and has the same diameter as flywheel 24. Front flywheel 25 has a hub 33 and a shaft 34. Again, it will be noted that the shaft 34 to the left of flywheel 25 is relatively short and of constant diameter. The shaft 34 to the right of flywheel 25 is of greater length, and the free end is tapered. The right end of shaft 34 is provided with a threaded axial bore 35 and a keyway 36. Again, the purposes of these last two mentioned elements will be apparent hereinafter. Finally, flywheel 25 may be provided with peripheral grooves 37 and 38 for the same reasons and of the same type discussed above with respect to grooves 31 and 32 of rearward flywheel 24.

Figure 14:
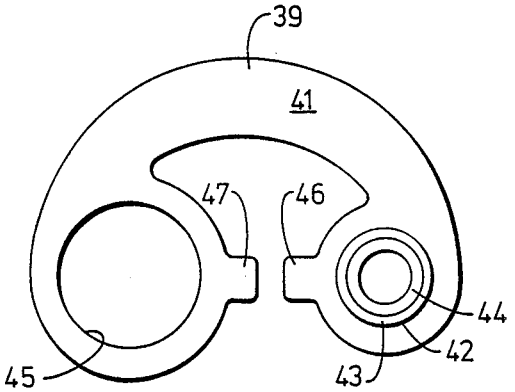
FIG. 14 is a side elevational view of the left load spring.
Figure 15:
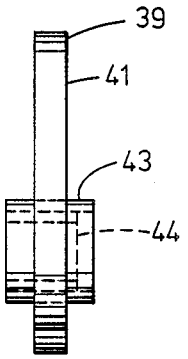
FIG. 15 is an end elevational view of the left load spring as seen from the right in FIG. 14.
Figure 8:
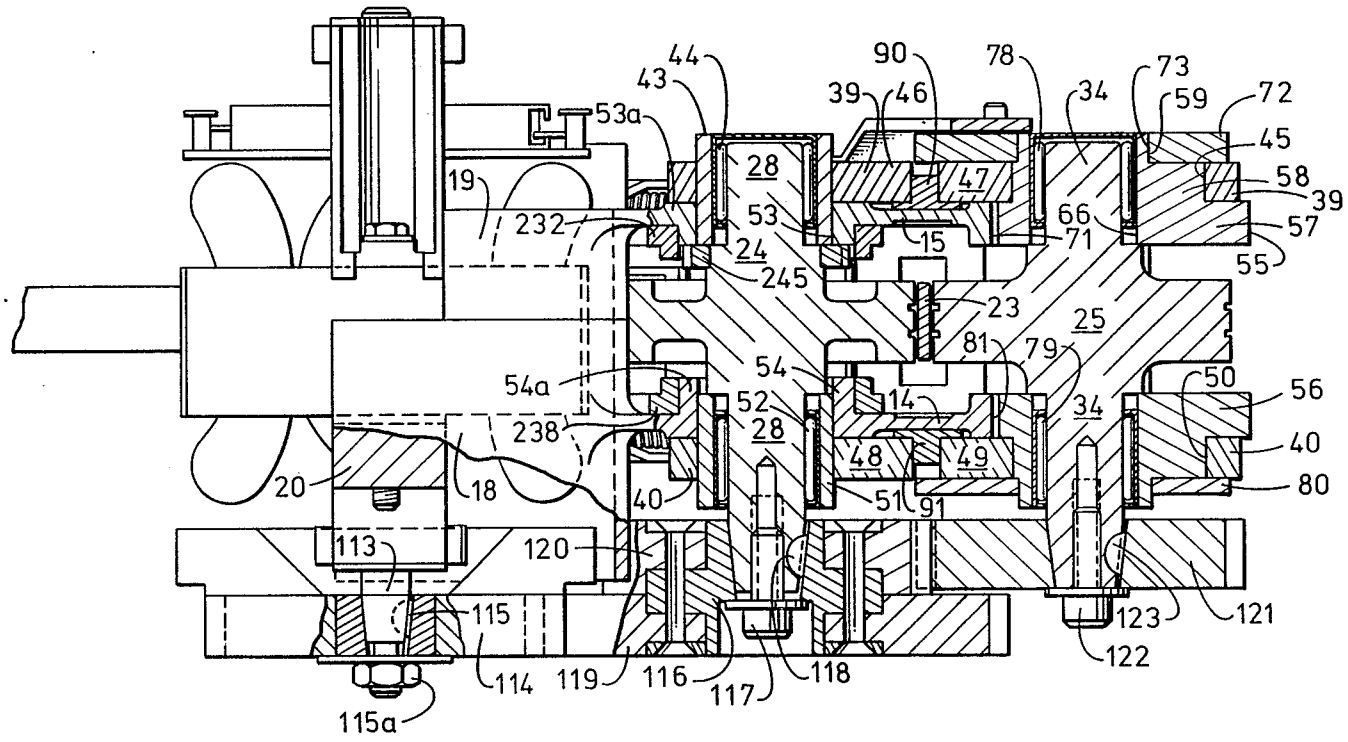
FIG. 8 is a fragmentary cross-sectional view taken along line 8—8 of FIG. 4.

As is perhaps most clearly shown in FIG. 8, the rearward flywheel 24 and the forward flywheel 25 are rotatively mounted in and between the right frame 14 and the left frame 15. Taking the rearward flywheel 24 first, its shaft 28 is received in bearing members constituting parts of the left and right load springs 39 and 40. The left load spring 39 is illustrated in FIGS. 14 and 15. Since the right load spring 40 is a mirror image of the left load spring, it is believed that a description of the left load spring 39 will suffice for and may be taken as a description of the right load spring 40 as well.

The left load spring 39 comprises an arcuate metallic bodY 41. The rearward end of body 41 has a perforation 42 therethrough. A metallic sleeve or bushing 43 is fixedly mounted on the perforation 42 and carries a needle bearing 44. The forward end of body 41 contains a large circular opening 45, the purpose of which will be apparent. The rearward end of body 41 has an integral lug 46. The forward end of body 41 has an integral lug 47. The lugs 46 and 47 are in spaced, opposed positions. The purpose of these lugs will be explained in due course.

Returning to FIG. 8, it will be noted that the right load spring 40 is provided with opposed lugs 48 and 49 similar to the above-described lugs 46 and 47. At its forward end, the right load spring 40 has a large opening 50 equivalent to the opening 45 of spring 39. Finally, at its rearward end the right load spring carries a metallic sleeve or bushing 51 containing a needle bearing 52.

As will be evident from FIGS. 3 and 8, left frame 15 has a circular opening 53 which receives the sleeve or bushing 43 of left load spring 39. Similarly, as shown in FIGS. 8 and 2, right frame 14 has a circular opening 54 which receives the sleeve or bushing 51 of right load spring 40. The left and right portions of rearward flywheel shaft 28 are rotatively mounted in bearings 44 and 52, respectively.

The large circular openings 45 and 50 in the forward ends of left load spring 39 and right load spring 40, respectively, are adapted to rotatively receive left bearing housing 55 and right bearing housing 56, respectively. Since right bearing housing 56 is a mirror image of left bearing housing 55, it is believed that a description of left bearing housing 55 can serve as a description of right bearing housing 56, as well.

Left bearing housing 55 is shown in FIGS. 16–19. The left bearing housing 55 is an integral, one-piece member comprising an inner base portion 57, an intermediate portion 58 and an outer portion 59. The inner base portion 57 has a circular peripheral portion 60 leading to rectilinear peripheral portions 61 and 62 which, in turn, are connected by an arcuate corner portion 63. The intermediate portion 58 has a circular peripheral surface 64 which is concentric with the arcuate peripheral portion of inner base portion 57 The outer portion 59 has a circular peripheral surface 65. It will be noted that the center of the circular peripheral surface 65 is offset with respect to the coaxial centers of peripheral surface 64 and peripheral surface portion 60.

A large bore 66 extends through the left bearing housing 55 and is coaxial with the peripheral surface 65 of outer portion 59. The intermediate portion 58 and inner base portion 57 have a pair of threaded bores 67 and 68 passing therethrough and an unthreaded bore 69 passing therethrough. Finally, the inner surface of the inner base portion 57 has a substantially rectangular depression 70 formed therein and about the bore 69.

Figure 5:
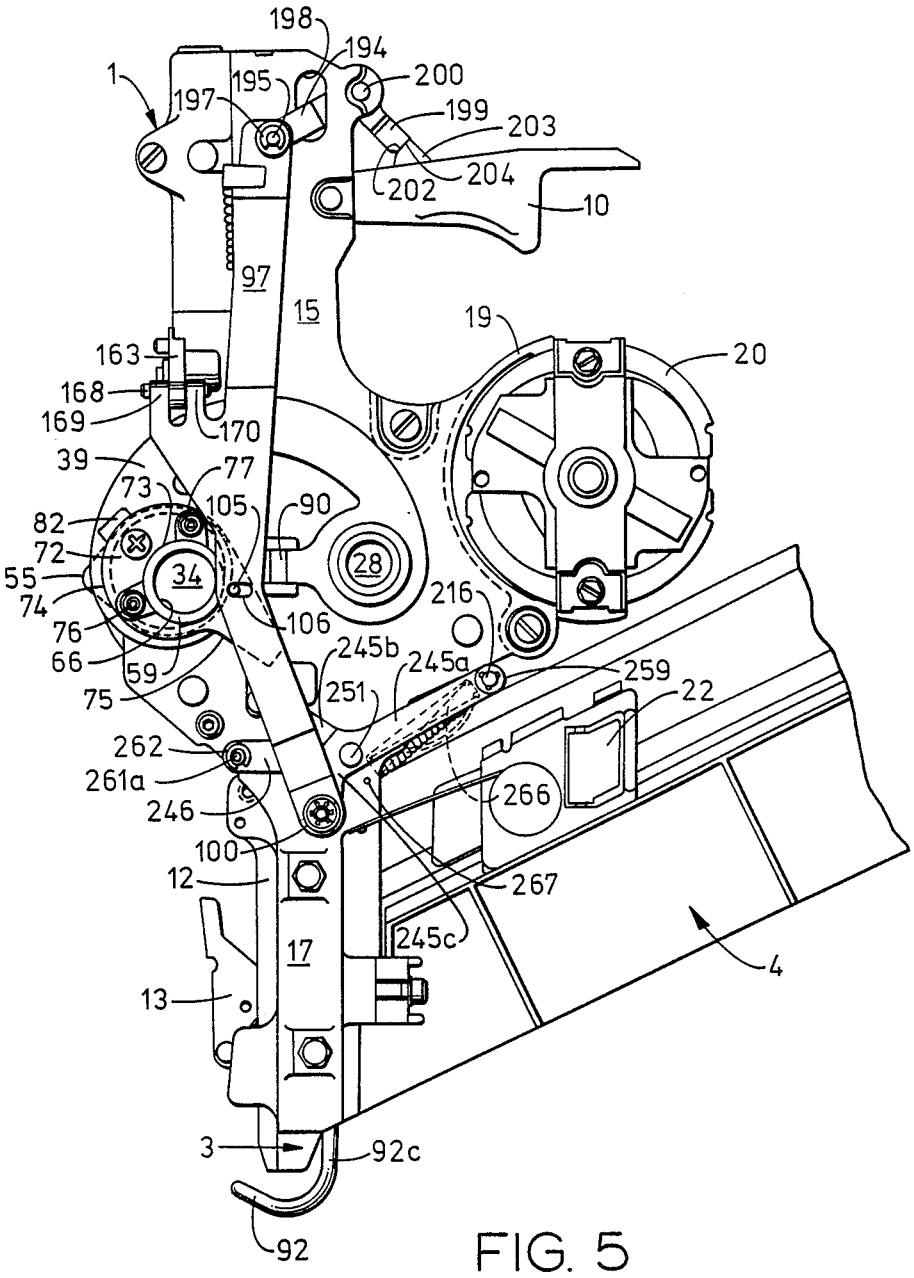
FIG. 5 is a fragmentary left side elevational view of the tool of FIG. 1 with the housing removed.

Turning to FIGS. 3, 5 and 8, the left frame 15 has a notch 71 formed in its forward edge. The rearward portion of notch 71 is circular and is of such diameter as to rotatively receive the inner base portion 57 of left bearing housing 55 with clearance. It will be evident from these figures that left bearing housing 55 can rotate through a partial turn within the left frame notch 71.

The intermediate portion 58 of left bearing housing 55 extends rotatively through the large opening 45 in the forward end of left load spring 39. As is most clearly seen in FIGS. 5 and 8, a plate 72 has a perforation 73 formed therein to receive the outer portion 59 of left bearing housing 55. The plate 72 has a circular peripheral surface 74 of greater diameter than and concentric with the circular periphery of the intermediate portion 58 of left bearing housing 55, except for a laterally extending nose 75 constituting an integral part of plate 72. Plate 72 is provided with a pair of holes (not shown) which correspond to threaded bores 67 and 68 in left bearing housing 55. In this manner, the plate 72 is affixed to the left bearing housing 55 by screws 76 and 77.

As is clearly shown in FIG. 8, the left portion of forward flywheel shaft 34 is mounted in a needle bearing 78. The needle bearing is mounted in bore 66 of left bearing housing 55. The left bearing housing 55 is rotatively mounted in the large opening 45 in the forward end of left load spring 39.

The right hand portion of forward flywheel shaft 34 is mounted in a needle bearing 79 located in right bearing housing 56 which is rotatively mounted in the large opening 50 in the forward end of right load spring 40. Right bearing housing 56 has a plate 80 affixed thereto. The plate 80 is a mirror image of plate 72, with the exception that it is somewhat thinner. Right bearing housing 56 is rotatively mounted in a notch 81 in the forward edge of right frame 14 (see FIG. 2).

From the above description it will be noted that the rearward flywheel 24 is rotatively mounted in needle bearings 44 and 52 located in the bushings 43 and 51 of left load spring 39 and right load spring 40. The left load spring bushing 43 is located in left frame opening 53. The right load spring bushing 51 is located in right frame opening 54. The flywheel, itself, is located between left frame 15 and right frame 14.

The forward flywheel 25 is also located between left frame 15 and right frame 14. The forward flywheel 25 is rotatively mounted in needle bearings 78 and 79 mounted in left bearing housing 55 and right bearing 56, respectively. In addition, the left bearing housing 55 is rotatively mounted in the notch 71 of left frame 15 and the large opening 55 in the forward end of left load spring 39. Similarly, the right end of forward flywheel shaft 34 is rotatively mounted in needle bearing 79 located in right bearing housing 56. Right bearing housing 56, itself, is rotatively mounted in the large opening 50 at the forward end of right load spring 40 and the notch 81 in right frame 14.

Figure 7:
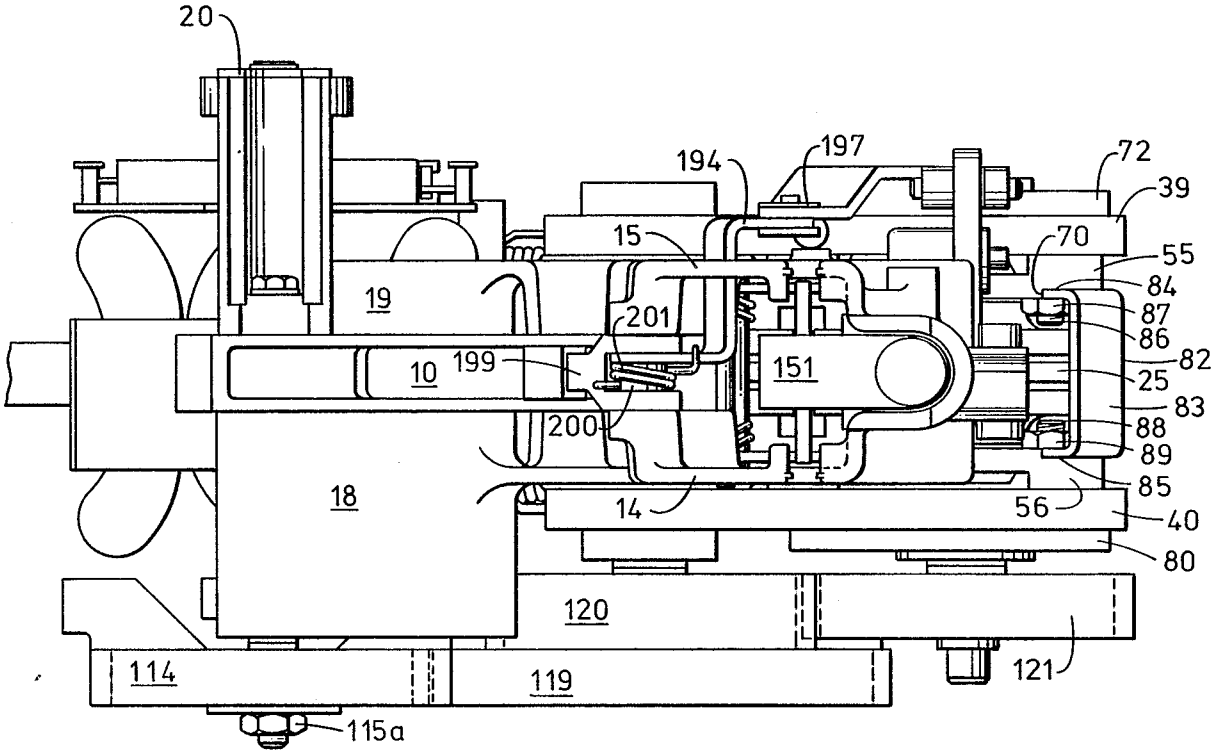
FIG. 7 is a fragmentary plan view of the tool of FIG. 1 with the housing removed.

The left bearing housing 55 and the right bearing housing 56 are joined together by a bracket 82 (see FIG. 7). The bracket 82 is U-shaped, having a base portion 83 and leg portions 84 and 85. The leg portion 84 is located in the substantially rectangular depression 70 and is affixed therein by a bolt 86 passing through the bore 69 of left bearing housing 55 and a hole (not shown) in leg 84 of bracket 82. The bolt 86 is provided with a nut 87.

The other end of bracket 82 is similarly affixed to bearing housing 56 by means of a bolt 88 and nut 89. As a result of bracket 82, left bearing housing 55 and right bearing housing 56 will rotate in their respective frame notches 71 and 81 together as a single unit.

Returning to FIG. 9, this figure illustrates the tool parts at their normal, at rest, unactuated positions. Under these conditions, the rearward flywheel 24 and the forward flywheel 25 are spaced from each other by a distance slightly greater than the maximum thickness of driver 23. Thus, under normal, unactuated conditions, driver 23 is out of contact with flywheels 24 and 25. This is also true during the return stroke of the driver, which will be described hereinafter.

In order for the flywheels 24 and 25 to actuate the driver through a driving or workstroke, it is necessary that one of the flywheels 24 and 25 be shiftable toward the other. In the particular embodiment illustrated, the forward flywheel 25 is shiftable toward and away from the rearward flywheel 24 as will be explained. Rearward flywheel 24 is capable of rotation only, while forward flywheel 25, on the other hand, is capable of rotation and of shifting toward and away from rearward flywheel 24 between an actuated and an unactuated position. As indicated above, in its unactuated position the distance between forward flywheel 25 and rearward flywheel 24 is slightly greater than the maximum thickness of driver 23. In its actuated position, the distance between forward flywheel 25 and rearward flywheel 24 is slightly less than the maximum thickness of driver 23, and slightly greater than the thickness of segment **23*i* of the driver. Thus, in the sequence of operations (which will be more fully described hereinafter), the tool operator first turns on the motor to cause the flywheels to be energized, and thereafter causes the forward flywheel to shift to its operative position. During these two steps, the driver does not move and is not contacted by the flywheels since, when the driver is in its normal, unactuated position, its thin segment 23*i* is located between the flywheels 24 and 25**.

In order for the driver 23 to be driven through a workstroke by flywheels 24 and 25, it must be physically shoved between the flywheels when forward flywheel 25 is in its operative position. The flywheels 24 and 25 will engage the driver ramps 36 and 35, respectively, and thereafter will engage the full thickness portion of the driver, driving it through its workstroke.

Since, in its operative position, the forward flywheel 25 is spaced from the rearward flywheel 24 by a distance less than the maximum thickness of driver 23, it will be necessary that the flywheels separate slightly as they engage ramps **23*l* and 23*m* and then the full thickness of the driver. At the same time, it is desirable to maintain a full, firm frictional engagement between the flywheels and the driver. This is accomplished by means of the load springs 39 and 40 which will allow the forward flywheel 25 to separate slightly from the rearward flywheel 24 while the flywheels continue to maintain a firm frictional engagement with the driver 23. Once the driver 23 has cleared the flywheels 24 and 25 near the end of its workstroke, the load springs 39 and 40 will snap the forward flywheel 25 back to its operative position. As is shown in FIG. 8, there is a block of resilient rubber or plastic material 90 located between the opposed lugs 46 and 47 of load spring 39. Similarly, there is a block of resilient rubber or plastic material 91 located between the opposed lugs 48 and 49 of load spring 40. The resilient blocks 90 and 91 serve to dampen any vibrations of load springs 39 and 40**.

Reference is now made to FIG. 5 for an explanation of the manner in which the forward flywheel 25 is shifted between its operative and inoperative positions. In FIG. 5, the shaft 34 of the forward flywheel 25 is shown in its normal, inoperative position. It will be remembered that each of the bearing housings 55 and 56 are rockable or partially rotatable in their respective notches 71 and 81 in the left and right frames 15 and 14. By virtue of the fact that the bearing housings are joined together by bracket 82, the bearing housings will work together as a single, unitary structure.

Since the bore 66 in which the forward flywheel shaft 34 is journaled is eccentrically located with respect to the center about which the left bearing housing 55 rotates or rocks, and since the same is true of the right bearing housing 56, it will be evident that if the bearing housings are rotated in a counterclockwise direction as viewed in FIG. 5, the shaft 34 of forward flywheel 25 will approach the nonshiftable shaft 28 of rearward flywheel 24. Similarly, if the bearing housing assembly is rocked or rotated in a clockwise direction as viewed in FIG. 5, the shaft 34 of the forward flywheel 25 will shift away from the shaft 28 of the rearward flywheel. It will be understood that the amount of shifting required by the forward flywheel 25 between its inoperative and its operative positions is very little, being of the nature of about 0.110 inch.

Figure 6:
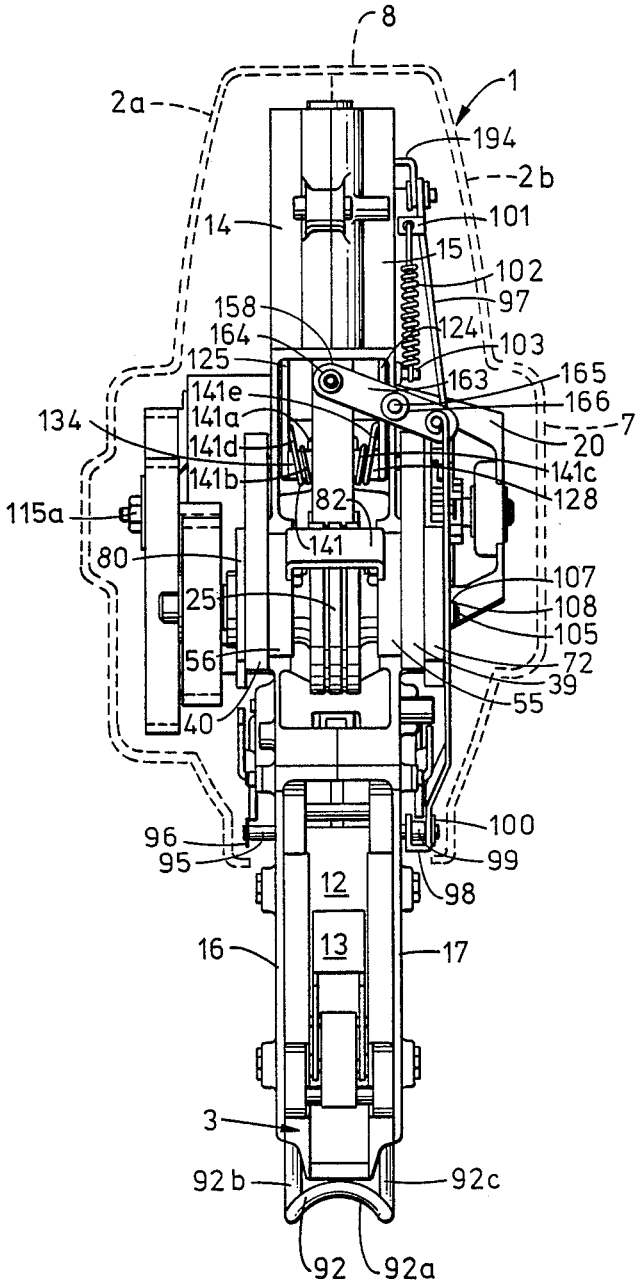
FIG. 6 is a front elevational view of the tool of FIG. 1 with the housing shown in broken lines.

Reference is now made to FIGS. 5 and 6. The fastener driving tool 1 is provided with a workpiece responsive trip or safety 92. The safety 92 comprises a U-shaped wire-like member having a base **92*a* terminating in right and left legs 92*b* and 92*c*. As viewed in FIGS. 5 and 6, the right and left legs 92*b* and 92*c* extend upwardly within frames 14 and 15 and are longitudinally slidable therein. The uppermost end of right leg 92*b* is bent outwardly and passes through an elongated slot 93 in right frame half 14 (see FIG. 2). Similarly, the uppermost end of left safety leg 92*c* is bent outwardly and extends through an elongated slot 94 in left frame 15 (see FIG. 3). As is most clearly shown in FIG. 6, the out-turned uppermost end of right safety leg 92*b* supports a bushing 95, held in place by a locking ring 96**.

On the lefthand side of tool 1 there is an elongated safety link indicated by index numeral 97. The lowermost end of safety link 97 is bent into a U-shape, as shown at 98. Both sides of the U-shaped configuration 98 are provided with coaxial holes so that the uppermost outwardly extending end of safety leg **92*c* can extend therethrough. Within the U-shaped end 98 of safety link 97 the uppermost end of safety leg 92*c* carries a bushing 99. The assembly is held together by a locking ring 100**.

Near its upper end, the safety link 97 has an inwardly extending tab 101. Tab 101 serves as an anchor for one end of a tension spring 102. The other end of tension spring 102 is anchored to a pin 103 located in a hole 104 in left frame 15 (see FIG. 3).

Turning to FIG. 5, the plate 72 affixed to left bearing housing 55 mounts an outwardly extending pin 105. The pin 105, in turn, extends through an elongated slot 106, extending transversely of safety link 97. That end of pin 105 extending through safety link 97 carries a washer 107 and a locking ring 108 (see FIG. 6) to maintain the parts in proper assembly. The washer and locking ring have been deleted from FIG. 5 so that the slot 106 can be clearly observed.

In FIGS. 5 and 6, the safety 92 and safety link 97 are illustrated in their normal, extended, unactuated positions, to which they are biased by tension spring 102. When the tool operator locates the lower end of guide body 3 against a workpiece at the position where a nail is to be driven, slight pressure by the operator will cause the workpiece responsive safety to shift upwardly to its actuated position so that the lower end of guide body 3 can contact the workpiece. This upward movement of safety 92 will result in simultaneous upward movement of safety link 97 against the action of return spring 102. At the same time, the engagement of pin 105 in slot 106 of the safety link 97 will cause bearing housings 55 and 56 to rock or rotate in a counterclockwise direction, shifting the shaft 34 of the forwardmost flywheel 25 from its inoperative to its operative position. After the nail driving operation, when the operator lifts the lower end of guide body 3 from the workpiece, safety 92 and safety link 97 will return to their normal positions under the influence of return spring 102, simultaneously causing clockwise rotation of bearing housings 55 and 56. This causes the return of the shaft 34 of the forwardmost flywheel 25 from its operative position to its normal, inoperative position.

At this point, the manner in which rotation is imparted to the flywheels will be described. Reference is first made to FIGS. 1 and 9. As indicated above, the tool 1 is provided with a single electric motor 20. The motor 20 is connected to a source of electrical current by a circuit which includes electrical cord 21 terminating in a conventional connector plug 21*a*. The circuit includes a conventional motor speed regulator unit (not shown), the manual adjustment knob of which is illustrated at 11 in FIG. 1. Finally, the circuit includes an on/off switch 9*a* having an actuator 9*b*. The switch 9*a* is of the type which is "on" when the actuator 9*b* is released, and which is "off" when the actuator 9*b* is depressed. The actuator 9*b* of on/off switch 9*a* is controlled by a manual motor trigger 9 mounted in the handle portion 6 of the tool body 2.

The motor trigger 9 is provided with a compression spring 109. The upper end of compression spring 109 (as viewed in FIG. 9) is anchored in a depression 110 formed in motor trigger 9. The lower end of compression spring 109 abuts a spring anchor 111 formed on the inside of housing 2. Compression spring 109 will normally maintain motor trigger 9 in the position shown In this position, the rearward end of motor trigger 9 engages and depresses actuator 9*b* so that on/off switch 9*a* will normally be in its "off" condition. The motor trigger 9 is so placed in the handle portion 6 of the tool body 2 that the operator will normally depress motor trigger 9 upon grasping the handle portion 6. This will cause motor trigger 9 to pivot in a clockwise direction about its pivot pin 112 and against the action of compression spring 109, releasing the actuator 9*b* so that switch 9*a* will be in its "on" state and the motor 20 will be energized.

Figure 4:
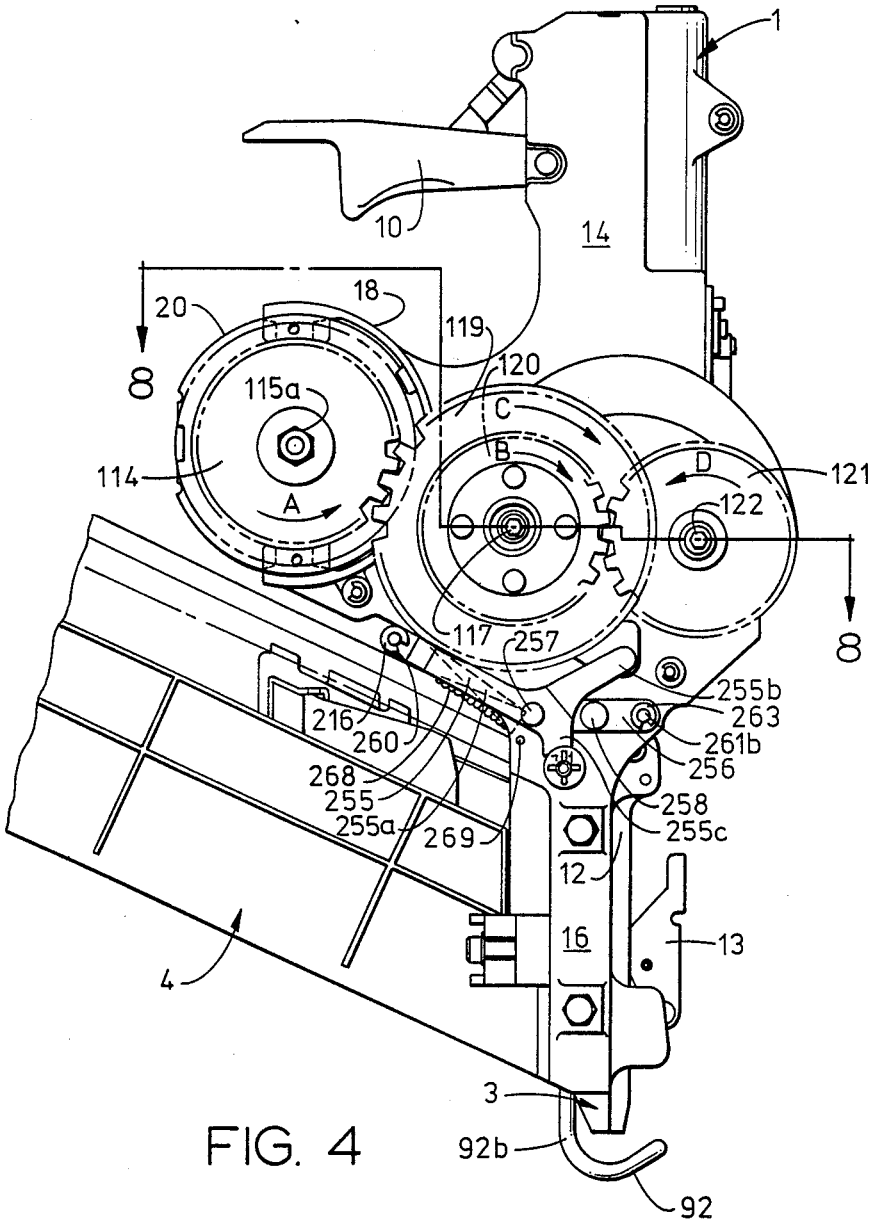
FIG. 4 is a fragmentary right side elevational view of the tool of FIG. 1 with the housing removed.

Turning now to FIGS. 4 and 8, the motor 20 has a shaft 113. A motor gear 114 is mounted on shaft 113 and is keyed thereto as at 115 and secured by hex nut 115*a*.

The elongated and tapered end of the rearward flywheel shaft 28 has a gear cluster 116 mounted thereon by a cap screw 117. The gear cluster 116 is keyed as at 118 to shaft 28 so as to be nonrotatable with respect thereto. The key 118 utilizes key slot 30 of shaft 28 (see FIG. 12). The gear cluster 116 comprises a large gear 119 and a smaller gear 120.

A forward flywheel gear 121 is affixed to the elongated and tapered portion of the forward flywheel shaft 34 by a cap screw 122. The forward flywheel gear 121 is keyed to shaft 34 as at 123, so as to be nonrotatable with respect thereto. The key 123 utilizes keyway 36 of shaft 34 (see FIG. 13).

In the arrangement just described, the teeth of motor gear 114 mesh with the teeth of large gear 119. The teeth of the small gear 120 mesh with the teeth of the forward flywheel gear 121. The gear teeth of small gear 120 and forward flywheel gear 121 are so designed that they can interdigitate to a greater or lesser degree. As a result of this, the teeth of small gear 120 and forward flywheel gear 121 are always meshed whether the forward flywheel is in its inoperative or operative position. As a result of this, the shifting of the forward flywheel 25 between its operative and inoperative positions does not effect the rotation of either of the flywheels 24 and 25.

As is most clearly shown in FIG. 4, the electric motor 20 is so designed that, when it is energized, it will result in counterclockwise rotation of motor gear 114, as indicated by arrow A. Since motor gear 114 meshes with large gear 119, the counterclockwise rotation of motor gear 114 will impart clockwise rotation to large gear 119 and small gear 120, as indicated by arrows B and C, respectively. Since the large gear 119 and small gear 120 are mounted on the shaft 28 of rearward flywheel 24, the rearward flywheel 24 will also be caused to rotate in a clockwise direction. The meshing of the small gear 120 and the forward flywheel gear 121 will result in counterclockwise rotation of the forward flywheel gear 121 as indicated by arrow D. Since the forward flywheel gear 121 is affixed to the shaft 34 of forward flywheel 25, the forward flywheel 25 will also rotate in a counterclockwise direction. In this manner, rearward flywheel 24 and forward flywheel 25 are counterrotating and both rotate in the proper direction to shift driver 23 through a work stroke. While it would be within the scope of the present invention to substitute a non-driven idler wheel for the forward flywheel 25 (as taught in the above-mentioned U.S. Pat. No. 4,298,072), the provision of two driven flywheels is preferred because they tend to counteract any precession forces created by the flywheels.

The driver 23 of the present invention is "free floating" in that there are no spring means, elastic cords or the like attached to it to return it to its uppermost position shown in FIG. 9 after completion of its nail-driving work stroke. Means for returning the driver to its uppermost position will be described hereinafter.

Figure 20:
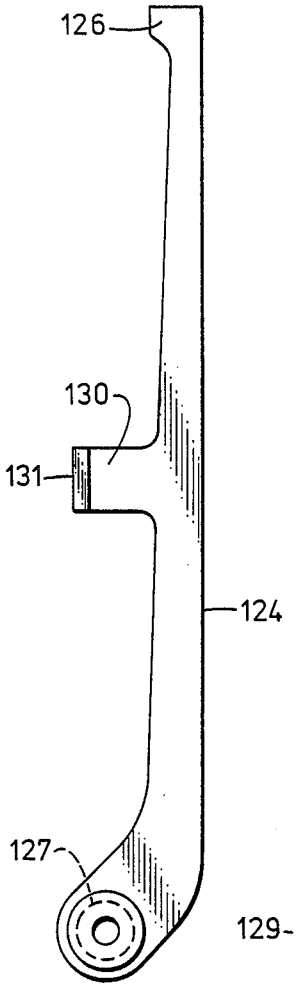
FIG. 20 is a side elevational view of the left driver locking member.
Figure 21:
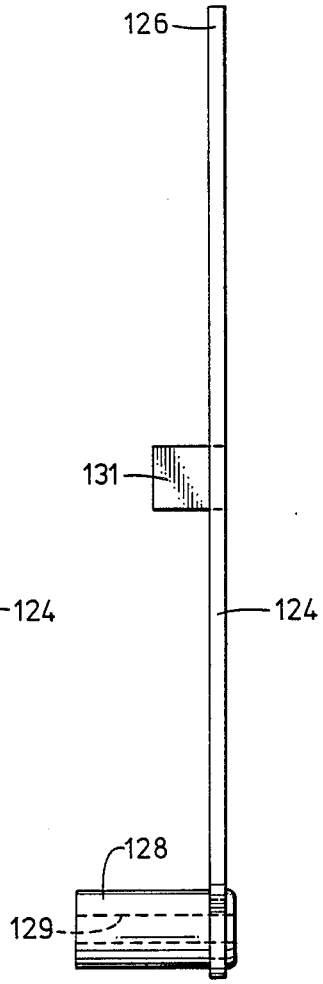
FIG. 21 is a front elevational view of the left driver locking member.
Figure 22:
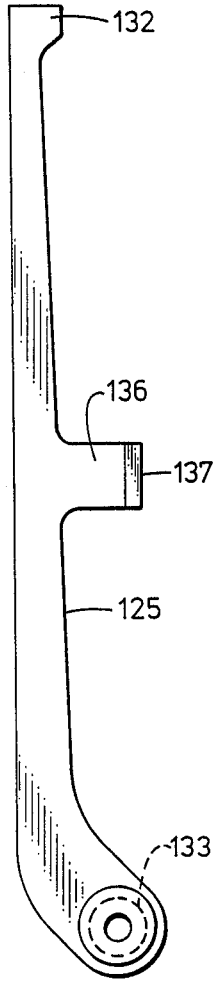
FIG. 22 is a side elevational view of the right driver locking member.
Figure 23:
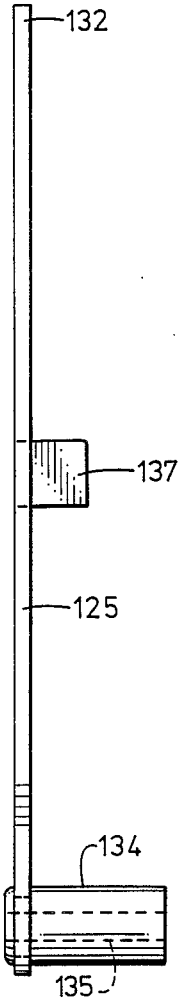
FIG. 23 is a front elevational view of the right driver locking member.
Figure 27:
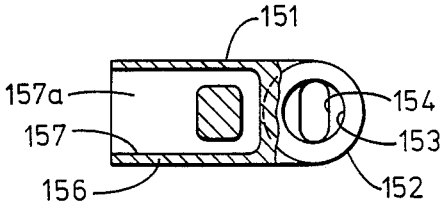
FIG. 27 is a plan view of the driver actuator, partly in cross section.
Figure 24:
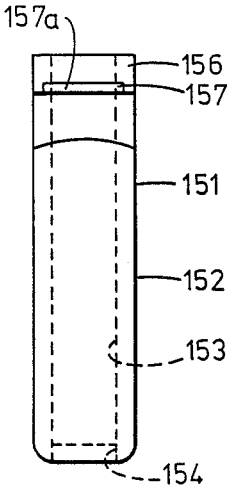
FIG. 24 is a rear elevational view of the driver actuator.
Figure 26:
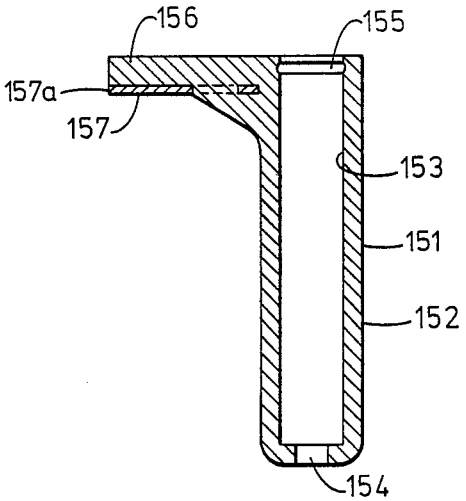
FIG. 26 is a cross-sectional view taken along section line 26—26 of FIG. 25.
Figure 25:
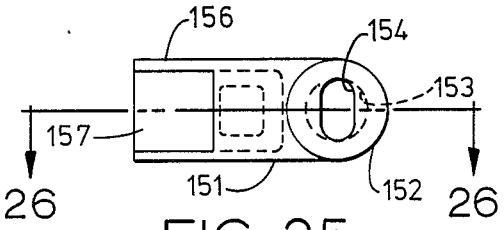
FIG. 25 is a bottom view of the driver actuator.
Figure 30:
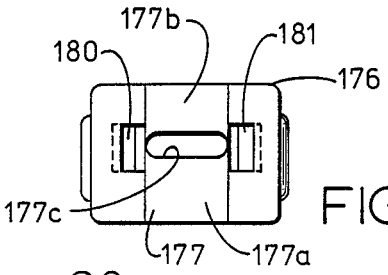
FIG. 30 is a plan view of the lower driver stop.
Figure 31:
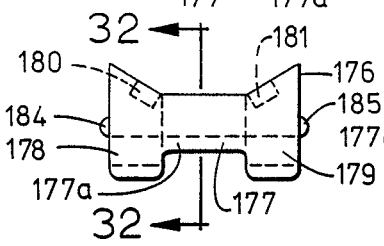
FIG. 31 is a front elevational view of the lower driver stop.
Figure 33:
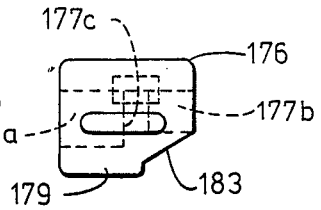
FIG. 33 is an end elevational view of the lower driver stop.

When the driver is in its uppermost, unactuated, normal position, means must be provided to maintain or lock the driver in this position until initiation of the next workstroke. This is accomplished through the use of a pair of left and right driver locking members. The left driver locking member is illustrated at 124 in FIGS. 20 and 21. The right driver locking member is illustrated at 125 in FIGS. 22 and 23. The left locking member 124 comprises an elongated, somewhat L-shaped member. The upper end (as viewed in FIGS. 20 and 21) terminates in an enlarged foot 126. The lower end (again as viewed in FIGS. 20 and 21) is also enlarged and is provided with a perforation 127. Mounted and staked in the perforation 127 there is a bushing 128 having a central bore 129. The left driver locking member 124 is completed by the provision of an integral rearwardly extending lug 130 terminating in a tab 131 extending in the same direction as bushing 128.

The right driver locking member 125 is a mirror image of the left driver locking member 124 having a foot 132, a perforation 133 containing a bushing 134 with an axial bore 135, and an integral lug 136 terminating in an in-turned tab 137.

Turning to FIGS. 6 and 9, the left and right driver locking members 124 and 125 are oriented with the free ends of their bushings 128 and 134 abutting. A shaft passes through the bores 129 and 135 of bushings 128 and 134, respectively. The shaft 138 (see FIG. 9), has one of its ends mounted in the perforation 139 of left frame 15 (see FIG. 3). The other end of shaft 138 is mounted in perforation 140 of right frame 14 (see FIG. 2). A torsion spring is indicated at 141. As is most clearly shown in FIG. 9, the torsion spring has a central U-shaped portion **141*a* which abuts bosses 142 and 143 of left and right frames 15 and 14 (see FIGS. 3 and 2). The U-shaped portion 141*a* terminates in a coiled portion 141*b* extending about driver locking member bushing 134. Similarly, the U-shaped portion 141*a* also terminates in a second coiled portion 141*c* extending about the driver locking member bushing 128. The coiled portion 141*b*, itself, terminates in an end 141*d* hooked over driver locking member 125. Similarly, the coiled torsion spring portion 141*c* terminates in an end 141*e* hooked over the driver locking member 124**.

It will be evident from FIG. 9 that the torsion spring 141 constantly urges both driver locking members 124 and 125 forwardly in a clockwise direction about shaft 138, to their normal positions illustrated in FIG. 9. It will be evident from FIG. 9 that when the driver locking members 124 and 125 are in their normal positions, the left driver locking member foot 126 will engage the shoulder **23*e* of driver 23 (see FIG. 10) and the right driver locking member foot 132 will engage driver shoulder 23*f*. In this way, the driver locking members 124 and 125 hold and lock the driver 23** in its uppermost, retracted, normal position.

It will further be evident from FIG. 9 that if the left and right driver locking members 124 and 125 were caused to rotate in a counterclockwise direction about pivot pin 138, the driver locking member shoes 126 and 132 would slip out from under driver shoulders **23*e* and 23*f*, respectively, leaving the driver free to be introduced between flywheels 24 and 25. This counterclockwise rotation of the driver locking members 124 and 125, about pivot pin 138, is accomplished by the manual driver trigger 10. The manual driver trigger 10 lends itself well to being molded of plastic or metal and is pivotal about pivot pin 144 (see FIG. 9). Pivot pin 144 has one end mounted in perforation 145 of left frame 15 (see FIG. 3). The other end of pivot pin 144 is mounted in perforation 146 in right frame 14 (see FIG. 2). The pivot pin 144 may be an integral part of driver trigger 10**, if desired.

Driver trigger 10 has a nose portion 147 which carries a transverse pin 148. When the manual driver trigger 10 is in its normal position and the driver locking members 124 and 125 are in their normal positions, the transverse pin 148 will reside directly in front of and be abutted by driver locking member tabs 131 and 137. This abutment determines the normal positions of the driver locking members 124 and 125. When the driver trigger 10 is actuated, it will pivot about pivot pin 144 in a clockwise direction pulling the transverse pin 148 downwardly and rearwardly against tabs 131 and 137. This in turn will cause counterclockwise rotation of the driver locking members 124 and 125 until such time as they release shoulders 28 and 29 of driver 23. At this point, the driver 23 is no longer supported and locked by the driver locking members 124 and 125 and is free to be introduced between the flywheels 24 and 25.

The manual driver trigger 10 is biased to its normal position by a compression spring 149. The compression spring 149 has its upper end abutting spring anchor 111 and its lower end abutting a depression 150 formed in the manual driver trigger. When manual driver trigger 10 is released by the operator, it will return to its normal position shown in FIG. 9 under the influence of compression spring 149. This, in turn, enables the driver locking members 124 and 125 to return to their normal positions under the influence of torsion spring 141. When the driver 23 is returned to its uppermost, normal position in the manner to be described hereinafter, the driver arms 26 and 27 will temporarily shift driver locking members 124 and 125 out of the way, until the feet 126 and 132 thereof can snap beneath the driver shoulders 28 and 29 by virtue of torsion spring 141.

When the driver locking members 124 and 125 have released the drivers through the agency of manual driver trigger 10, it is necessary to provide means to urge the driver into the bite of the counterrotating flywheels 24 and 25. This is accomplished by a driver actuator, next to be described. The driver actuator 151 is illustrated in FIGS. 24 through 27. The driver actuator 151 has a main cylindrical body portion 152, having an axial bore 153. The axial bore 153 is open at its upper end, and is closed at its lower end except for a narrow, elongated perforation 154. Near its upper end, the axial bore 153 has an annular notch 155 formed therein. The driver actuator cylindrical body portion 152 may have its upper end closed by a cap **152*a* having an annular rib cooperating with annular notch 155 with a snap fit. Near the upper end of cylindrical body 152 there is a laterally extending arm 156. The arm 156 has a depression 157 formed in its underside, adapted to receive a hardened metal plate 157*a***, to guard against wear.

Reference is now made to FIG. 9. The driver actuator 151 is located between right and left frames 14 and 15, which maintain the actuator arm 156 properly oriented. It will be noted that when the driver 23 is in its normal, retracted position, the arm 156 of driver actuator 151 overlies the upper end of the driver 23.

A rod-like actuator link 158 extends through the perforation 154 in the bottom of the driver actuator body 152 and into the bore 153 thereof. The uppermost end of actuator link 158 is provided with a washer 159 and a clamp ring 160. A compression spring 161 is located within the bore 153. The upper end of compression spring 161 abuts the washer 159. The lower end of the compression spring 161 abuts the lower end of the driver actuator body 152.

Reference is now made to FIGS. 5, 6 and 9. As is most clearly shown in FIG. 9, the lower end of actuator link 158 is bent outwardly as at 162. The actuator link end 162 extends rotatively through a perforation in an actuator lever 163. The actuator link end is secured in place with respect to the actuator lever 163 by a locking ring 164 (see FIG. 6).

The actuator lever 163 is rotatively mounted on left frame 15 by a pin 165 and a locking ring 166. The pin 165 is located in the socket 167 formed in left frame 14 (see FIG. 3).

The other end of actuator lever 163 is pivotally mounted by a pin 168 between bifurcations 169 and 170 formed in safety link 97.

From the above description it will be apparent that when the bottommost end of guide body 3 is pressed against the workpiece to be nailed, and when, as a consequence, the safety 92 and safety link 97 shift upwardly, as previously described, the actuator lever 163 will be rotated in a counterclockwise direction as viewed in FIG. 6. Counterclockwise rotation of actuator lever 163 will cause actuator link 158 to be pulled downwardly, compressing spring 161 within driver actuator 151. When the driver locking members 124 and 125 release the driver, driver actuator 151 and its arm 156 are free to shove downwardly on driver 23, under the influence of spring 161, introducing the driver between flywheels 24 and 25 to be driven through a workstroke.

When the lowermost end of the guide body 3 is lifted from the workpiece, and the safety 92 and safety link 97 are shifted to their lower normal positions under the influence of return spring 102 (see FIG. 6) the actuator 151, spring 161, actuator link 158 and actuator lever 163 will all return to their normal positions shown in FIGS. 5, 6 and 9.

Figure 28:
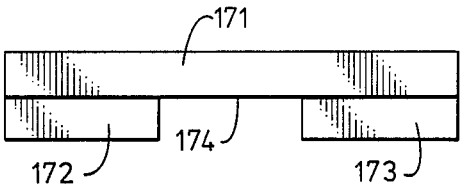
FIG. 28 is a front view of the upper stop.
Figure 29:
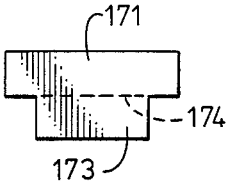
FIG. 29 is an end view of the upper stop.
Figure 16:
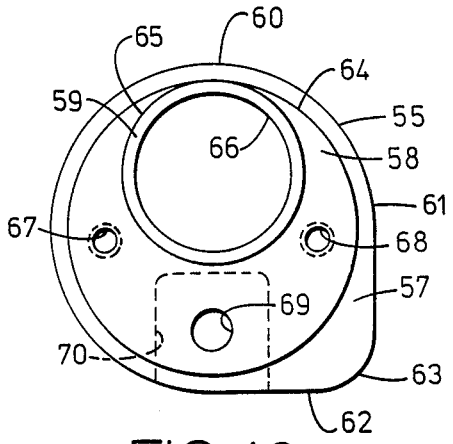
FIG. 16 is an outside elevational view of the left bearing housing.
Figure 17:
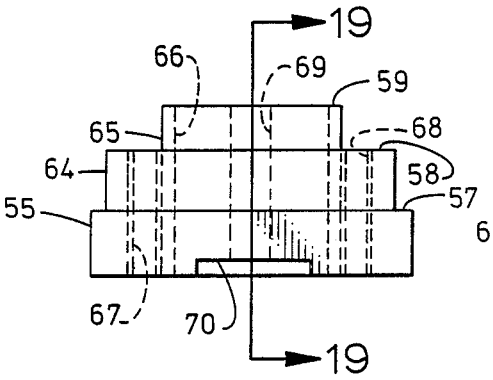
FIG. 17 is an elevational view of the left bearing housing as seen from the bottom of FIG. 16.
Figure 19:
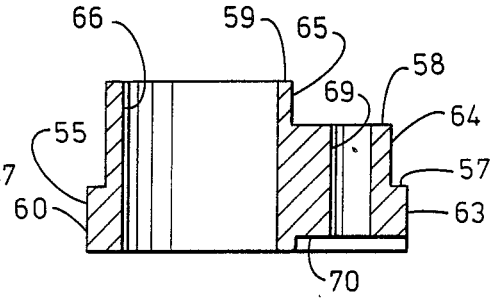
FIG. 19 is a cross-section view of the left bearing housing taken along section line 19—19 of FIG. 17.
Figure 18:
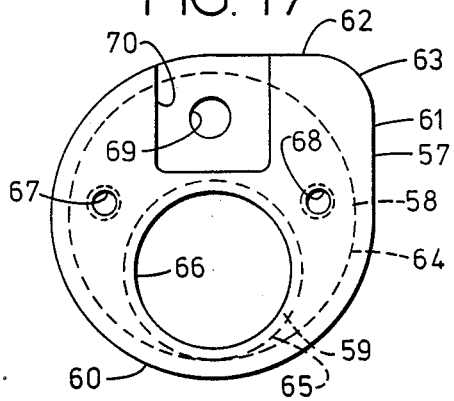
FIG. 18 is an inside elevational view of the left bearing housing.

When the driver is caused to execute its return stroke by means to be described hereinafter, the actuator 151 and its spring 161 will tend to cushion the return of the driver. In addition, the housing cap 8 may be provided with an upper stop. This upper stop is illustrated in FIGS. 28 and 29. The upper stop is indicated at 171 and comprises a block-like member of resilient rubber or plastic. At either end, the upper stop 171 has downwardly depending portions 172 and 173. These portions are intended to be contacted by the upper end of driver 23. The intermediate portion 174 is intended to be contacted by driver actuator 151. The upper stop 171 may be affixed to the inside surface of cap 8 by any appropriate means, including adhesive means and the like.

Guide means are provided for the driver during its work and return strokes. These guide means take the form of small rollers provided with needle bearings and supported on shafts mounted on the frames 14 and 15. Three such rollers 175 are illustrated in FIG. 9. The tool is also provided with an upper driver guide **175*a* (FIG. 9). The upper driver guide 175*a* is a resilient plastic member which assures that, as the driver 23 completes its return stroke, its upper end will be in proper position for engagement by driver locking members 124 and 125**.

Figure 32:
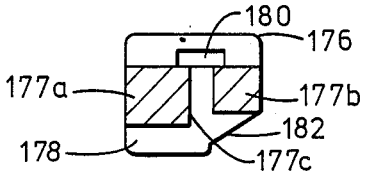
FIG. 32 is a cross-sectional view of the lower driver stop taken along section line 32—32 of FIG. 31.

The tool 1 of the present invention is provided with a lower stop for the driver. The lower stop absorbs any energy remaining at the end of the drive stroke. The lower stop comprises a resilient insert 176. As is clearly shown in FIG. 9, the lower stop 176 is located just beneath the flywheels 24 and 25. The lower stop is more clearly illustrated in FIGS. 30 through 33. The lower stop 176 comprises an integral, one-piece member having a central portion 177 and enlarged end portions 178 and 179. The central portion 177 is made up of two parts **177*a* and 177*b*. As is most clearly shown in FIG. 32, the part 177*a* is of rectangular cross section. The same is true of part 177*b*. The part 177*b*, however, is smaller than the part 177*a*. The upper surfaces of parts 177*a* and 177*b* are substantially coplanar. The parts 177*a* and 177*b* are separated from each other by a space 177*c*. The space 177*c* comprises a slot for the receipt of the shank of the driver 23**.

End portions 178 and 179 of the lower stop are enlarged and are essentially mirror images of each other. The upper surfaces of end parts 178 and 179 are planar and slope downwardly and inwardly toward the upper surfaces of parts **177*a* and 177*b***.

Hard metal inserts 180 and 181 are embedded in the upper surfaces of end parts 178 and 179. The lower rearward corners of end parts 178 and 179 are relieved as at 182 and 183. The insert is completed by lateral ribs 184 and 185 formed on the outside surfaces of parts 178 and 179.

Figure 34:
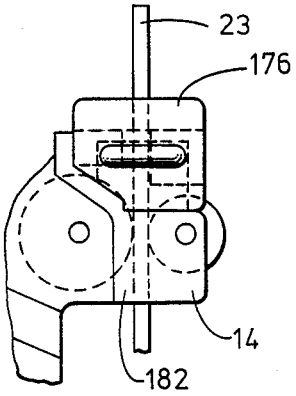
FIG. 34 is a fragmentary side elevational view illustrating the lower stop mounted in the tool.
Figure 35:
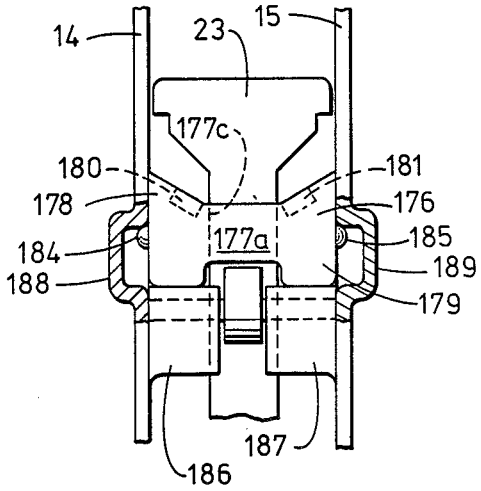
FIG. 35 is a fragmentary front elevational view of the structure of FIG. 34.

FIGS. 34 and 35 illustrate the lower driver stop mounted between right and left frames 14 and 15. The right and left frames 14 and 15 are provided on their inside surfaces with support members 186 and 187, respectively, adapted to receive and support the lower driver stop 176. The right and left frames 14 and 15 are also provided with outwardly extending detents 188 and 189. The lower driver stop ribs 184 and 185 are received within detents 188 and 189. The detents 188 and 189 also provide voids into which the lower driver stop 76 can expand when it is hit by the upper portion of the driver at the end of the drive stroke.

It will be noted that the upper surfaces of the enlarged end portions 178 and 179 lie at a lesser angle than the corresponding surfaces of the enlarged upper end of driver 23. This is to cause the contact between the two to be gradual, rather than a single face-to-face abutment. Initial contact of the lower driver stop and the upper end of driver 23 is at or near metal inserts 180 and 181, to prevent undue wear of the lower driver stop.

As will be pointed out more fully hereinafter, in order for the tool 1 to function properly, the various tool mechanisms must perform their functions in the proper order. For example, the first step should be the energization of the motor to bring about counterrotation of the flywheels 24 and 25. Thereafter, the forward flywheel 25 should be shifted to its operative position and the driver actuator spring 161 should be compressed to ready the driver actuator 151 for insertion of the driver 23 between the flywheels. At this point, the manual driver trigger 10 is actuated to release the driver 23 and cause the driver to travel through a workstroke. Thereafter, the manual driver trigger 10 should be returned to its normal position so that the driver locking members 124 and 125 can lock the driver 23 in its normal uppermost position, at the end of its return stroke. Furthermore, before the return stroke of the driver is initiated, the forward flywheel 25 should be shifted to its inoperative position and the driver actuator 151 should return to its normal, unactuated position.

For these reasons, the tool 1 should be a restrictive sequential tool. In other words, means must be provided to prevent actuation of the manual driver trigger 10 ahead of the shifting of safety 92 to its uppermost, retracted position. Means must also be provided to prevent actuation of the manual driver trigger 10 before actuation of the motor trigger 9.

Reference is made to FIG. 9. It will be noted that the motor trigger 9 has a downwardly depending extension 190 terminating in a flat surface 191. The manual driver trigger 10 has a rearward extension 192 terminating in a surface 193 opposed to surface 191. It will be evident that abutment of surfaces 191 and 193 will preclude actuation of the manual driver trigger 10 if motor trigger 9 is unactuated. Actuation of motor trigger 9, however, will cause the extension 190 to pivot about pivot pin 112 so that its surface 191 no longer opposes the manual driver trigger surface 193. As a consequence of this construction, motor trigger 9 must always be actuated before manual driver trigger 10 can be actuated.

To assure that the manual driver trigger 10 cannot be actuated before the safety 92 is shifted to its upper, retracted position a trigger disabling link is pivotally affixed to the uppermost end of safety link 97. The trigger disabling link 194 (FIGS. 5, 7 and 9) is provided at one end with a pivot pin 195 which extends through a clearance hole (not shown) in the upper end of safety link 97. This assembly is held in place by a locking 197. The trigger disabling link 194 passes through an elongated slot 198 in left frame 15 (see FIG. 3). The other end of trigger disabling link 94 is located between the bifurcations of a trigger stop 199, and both elements are pivoted together and between right and left frames 14 and 15 by pivot pin 200 see FIGS. 5 and 7). The trigger stop is maintained in its normal position by a torsion spring 201 best seen in FIGS. 7 and 9. The trigger stop 199 terminates in an abutment surface 202.

Referring to FIG. 9, the manual driver trigger 10 has an upstanding portion 203 providing an abutment surface 204 adapted to cooperate with abutment surface 202 of trigger stop 199. It will be apparent from FIGS. 5 and 9 that when the safety 92 is in its normal, lower, extended position, the trigger stop surface 202 will abut the manual driver trigger surface 204 precluding actuation of the manual driver trigger 10. On the other hand, when the safety 92 is shifted to its upper, retracted position, the safety link 97 will be shifted upwardly, causing rotation of the trigger disabling link 194 and the trigger stop 199 in a clockwise direction as viewed in FIG. 5 and a counterclockwise direction as viewed in FIG. 9. At this point, the trigger stop 199 will have pivoted to a position opposite a depression 205 formed in manual driver trigger 10. The trigger stop 199 is receivable within the depression 205 so that, under these circumstances, manual driver trigger 10 can be actuated. If the manual driver trigger 10 is actuated, the trigger stop 199 is trapped within depression 205 and cannot withdraw from the depression 205 until the manual driver trigger 10 is returned to its normal, unactuated position. As a result of this, the safety 92 must be shifted to its upper, retracted position before manual driver trigger 10 can be actuated. Furthermore, the manual driver trigger 10 must be released to its normal, unactuated position before the safety 92 can return to its normal, extended position.

The trigger stop 199 is pivoted by pivot pin 201 to trigger disabling link 194 to prevent trigger stop 199 from being broken if pressure is applied to trigger 10 while attempting to shift safety link 97 to its upper retracted position. The trigger stop 199 will be returned to its normal position and is generally retained in its normal position by torsion spring 201.

The tool 1 of the present invention is provided with a mechanical driver return mechanism which does not require the driver 23 to be connected to elastic cords, springs, combinations thereof, and the like. The driver return mechanism will next be described.

Turning first to FIG. 9, the return stroke of driver 23 is caused by engagement of the driver 23 by a driven return roller 206 and an idler return roller 207 when driver 23 is so engaged between driven return roller 206 and idler return roller 207, the driven return roller 206 will cause the driver to rapidly execute a return stroke. The idler return roller 207 is provided with needle bearings and is mounted on a shaft, the ends of which are located in perforations 208 and 209 of right and left frames 14 and 15 (see FIGS. 2 and 3).

The driven return roller constitutes a part of a driver return assembly illustrated in FIG. 9 and in FIGS. 36, 37 and 38. The driver return assembly comprises an elongated gear frame 210 having a central body portion 211 terminating at its rearward end in bifurcations 212 and 213 and at its forward end in bifurcations 214 and 215. The rear bifurcations 212 and 213 support a gear frame pin 216 to be further described hereinafter. The body portion 211 of the gear frame 210 has a first transverse bore 217 which rotatively receives a cluster gear shaft 218, held in place by a locking ring 219. The cluster gear shaft 218 supports a large gear 220 and a small gear 221.

The body portion 211 of the gear frame 210 has a second transverse perforation 222 containing an intermediate gear shaft 223. The intermediate gear shaft 223 supports a first intermediate gear 224 and a second intermediate gear 225.

The bifurcations 214 and 215 at the forward end of gear frame 211 support a return roller shaft 226. The return roller shaft 226, in turn, supports a return roller gear 227 and the driven return roller 206. The return roller shaft 226, return roller gear 227 and driven return roller 206 are more clearly shown in FIG. 38. The return roller gear 227 has a cylindrical extension 228. The return roller gear 227 and its extension 228 are provided with a pair of bearings 229 and 230 on return roller shaft 226. The return roller 206, itself, is nonrotatively affixed to the cylindrical extension 228 of return roller gear 227. The remainder of the return roller shaft 226, between bearing 230 and bifurcation 214, supports a spacer member 231.

Figure 40:
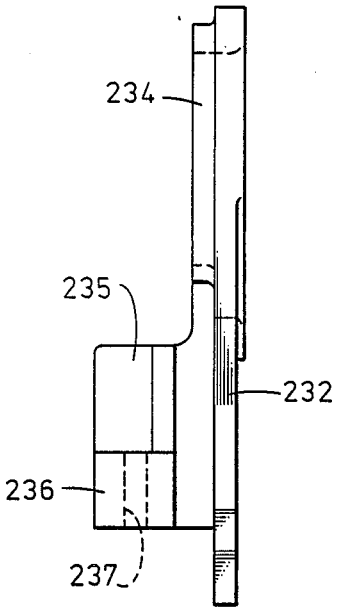
FIG. 40 is an end elevational view of the left return assembly hanger, as seen from the left in FIG. 39.
Figure 39:
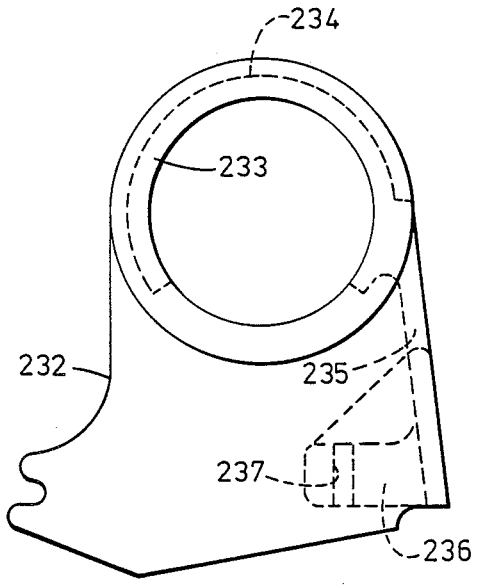
FIG. 39 is an outside elevational view of the left return assembly hanger.
Figure 41:
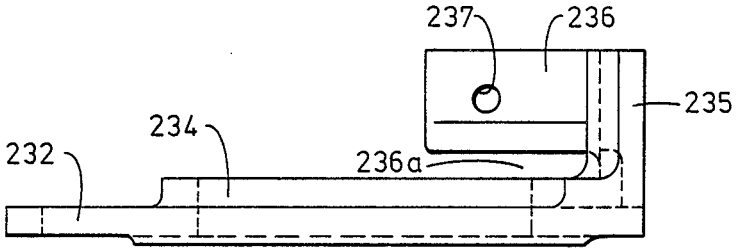
FIG. 41 is a plan view of the left return assembly hanger as seen from the top of FIG. 39.

The return assembly just described is supported by right and left hanger members. The left hanger member is illustrated in FIGS. 39 through 41 and is indicated by index numeral 232. Left hanger 232 comprises an upright substantially planar member having at its upper end a large circular opening 233. On the inside surface of the hanger 232 an annular, integral reinforcing rim 234 surrounds all but about the bottom one-third of the circular opening 233. Along the rearward edge of hanger 232 there is an inwardly extending web 235 which supports a block-like lug 236. The lug 236 has a vertical perforation 237 formed therein. The slot **236*a* between lug 136 and the inside surface of hanger 232 provides clearance for return assembly gear 220**.

Figure 42:
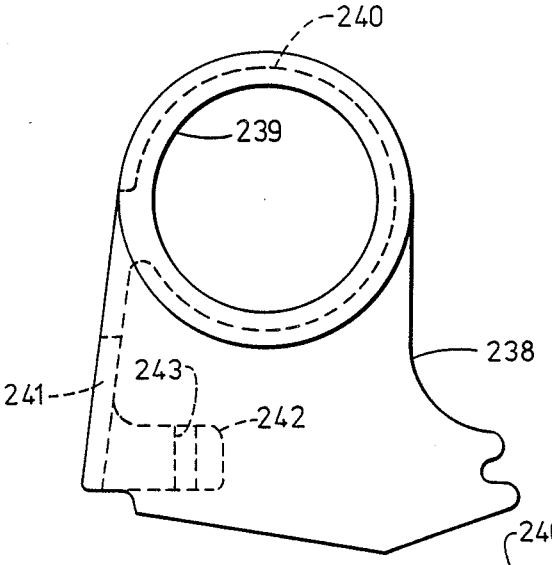
FIG. 42 is an outside elevational view of the right return assembly hanger.

The right hanger is illustrated in FIG. 42 at 238. The right hanger 238 is substantially a mirror image of left hanger 232, having a large circular opening 239, an annular reinforcing rib 240 on its inside surface about the opening 239, an inwardly extending web 241 and a block-like lug 242 with a vertical perforation 243 formed therein. The differences between the right hanger 238 and the left hanger 232 are that the annular reinforcing rib 240 extends fully about the circular opening 239, and the outer wall and the block-like lug 242 are not separated by a slot.

In FIG. 9, the left hanger 232 is shown affixed to the return assembly 210. As will be noted from FIG. 36, the return assembly gear frame 211 has, near its rearward end, a pair of holes **211*a* and 211*b*. In FIG. 9, the block-like lug 236 of left hanger 232 is shown located on the rearward end of gear frame 211 with a screw 244 passing through the perforation 211*a* of the gear frame 211 and threadedly engaging the perforation 237 of lug 236. It will be understood that the right hanger 238 will similarly be affixed to the gear frame 211 with a screw (not shown) passing through gear frame perforation 211***b* and threadedly engaged in right hanger lug perforation 243.

Turning to FIG. 3, it will be noted that the large perforation 53 in the left frame 15 is surrounded on the inside surface of the left frame by an annular rim 53*a*. It will similarly be noted from FIG. 2 that the large opening 54 in the right frame 14 is surrounded on the inside surface of the right frame by an annular rim 54*a*. The annular rims 53*a* and 54*a* are shown in FIG. 8. FIG. 8 also illustrates the left hanger 232 rotatively mounted on the side frame rim 53*a*, the side frame rim 53*a* being received in the left hanger circular opening 233. In a similar fashion, the right hanger 238 is shown rotatively mounted on the right frame rim 54*a*. Finally, FIG. 8 shows a gear 245 non-rotatively affixed to the transition portion of the shaft 28 of rearward flywheel 24.

It will be evident from FIG. 9 that by virtue of the left and right hangers 232 and 238 the return assembly 210, including the driven return roller 206 is swingable toward and away from the fixed idler return roller 207. The large gear 220 is always meshed with gear 245, regardless of the position of the return assembly 210. This is true because the axis about which the hangers swing is coaxial with the axis of gear 245 and the axis of the shaft 28 of rearward flywheel 24. The left hanger rib 234 is discontinuous to provide room for the meshing of gears 220 and 245. Since the rearward flywheel 24 rotates in a clockwise direction as viewed in FIG. 9 and as indicated by arrow E, the gear 245 will rotate in the same direction. The large gear 220 of the return assembly will rotate in a counterclockwise direction as indicated by arrow F in FIG. 37. The same is true of small gear 221, indicated by arrow G. The small gear 221 meshes with the first intermediate gear 224, causing it to rotate in a clockwise direction as indicated by arrow H. The second intermediate gear 225 will rotate in the same clockwise direction, indicated by arrow I. Since the second intermediate gear meshes with the return roller gear 227, the return roller 206 and the return roller gear 227 will rotate in a counterclockwise direction, as indicated by arrow J. It will be apparent from FIG. 9 that a counterclockwise rotation of driven return wheel 206 is desired to shift the driver 23 through its return stroke.

Figure 43:
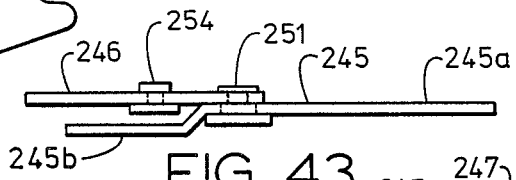
FIG. 43 is a plan view of the left return linkage.
Figure 44:
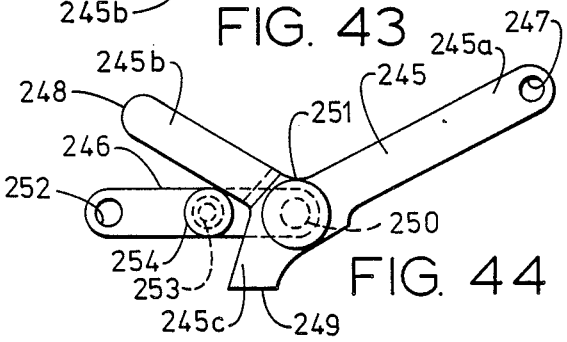
FIG. 44 is an elevational view of the left return linkage.

The return system of the present invention is completed by the provision of means to shift the driven return roller 206 and its return assembly away from roller 207 by a distance greater than the greatest nominal thickness of driver 23 during the work stroke of the driver, and to shift the driven return roller 206 and its return assembly toward fixed roller 207 to engage the driver 23 therebetween for the return stroke. The means for performing this constitute a left return linkage and a right return linkage. The left return linkage is illustrated in FIGS. 43 and 44. The left return linkage comprises a first link 245 and a second link 246. The first link 245 has a rearwardly and upwardly extending arm 245*a*, a forwardly and upwardly extending arm 245*b* and a downwardly extending arm 245*c*. The free end of arm 245*a* is provided with a perforation 247. The arm 245*b* terminates in a rounded end 248 and the arm 245*c* terminates in an abutment surface 249. At the juncture of arms 245*a*, 245*b* and 245*c*, the link 245 is provided with a perforation 250 for the receipt of a rivet 251.

Link 246 is a simple straight link. One end of link 246 is pivotally attached to link 245 by the rivet 251. The other end of link 246 is provided with a perforation 252. The body portion of link 246 is provided with a perforation 253 in which a rivet 254 is mounted. It will be noted, particularly from FIG. 43, that the arm 245*b* of link 245 is slightly offset from the other arms 245*a* and 245*c*.

The right return linkage is illustrated in FIG. 4 and comprises a first link 255 and a second link 256 The first link 255 is a mirror image of link 245 of FIG. 44, having a first arm 255*a*, a second arm 255*b* and a third arm 255*c* substantially identical to arms 245*a*, 245*b* and 245*c* of FIG. 44. The second link 256 is a mirror image of link 246 and is pivoted at one end to link 255 by rivet 257. The body of link 256 carries a second rivet 258 identical to rivet 254 of FIG. 44.

FIGS. 4 and 5 illustrate the right and left return linkages mounted on the tool 1. The free ends of link arms 245*a* and 255*a* are pivotally mounted on adjacent ends of gear frame pin 216 (see FIG. 36) and are held thereon by locking rings 259 and 260. The free ends of links 246 and 256 are rotatively mounted on a pair of pins 261*a* and 261*b* by locking rings 262 and 263. The pin 261*b* is mounted in perforation 264 in right frame 14 (see FIG. 2) and the pin 261*a* is mounted in perforation 265 in left frame 15 (see FIG. 3). It will be noted from FIG. 4 that the abutment end of arm 255*c* is located directly over the outturned end of the leg 92*b* of safety 92. Although obscured by the lower end of safety link 97, it will still be apparent from FIG. 5 that the abutment end of link arm 245*c* rests directly above the outturned end of leg 92*c* of safety 92.

The return mechanism is completed by the provision of a pair of tension springs. The first tension spring is shown in FIG. 5 at 266. One end of spring 266 is connected to gear frame 216. The other end of spring 266 is engaged in a hole 267 in left frame 15. The other tension spring is shown in FIG. 4 at 268. One end of the tension spring 268 is engaged about the gear frame pin 216. The other end of tension spring 268 is engaged in a hole 269 in right frame 14.

From the above description, it will be evident that when the lower end of guide body 3 is pressed against a workpiece to be nailed, and the safety 92 is shifted upwardly to its retracted position, the outturned ends of the legs of safety 92 will engage the abutment surfaces of return linkage arms 245*c* and 255*c* shoving them upwardly against the action of tension springs 266 and 268. Both return linkages will be shifted upwardly to an over center position determined by the abutment of rivet 258 and link arm 255*c* of the right return linkage and the arm 245*c* with a rivet (not shown) similar to rivet 258 on the left return linkage. This upward shifting of the right and left return linkages will shift the powered return roller 206 and the return assembly 210 away from fixed return roller 207 so that the driver 23 is free to pass unimpeded therebetween during its workstroke.

When the guide body 3 is lifted from the workpiece and the safety 92 and safety link 97 shift downwardly to their normal extended positions, it will be remembered that bearing housings 55 and 56 will rotate together in a clockwise direction as viewed in FIG. 5 to cause the forward flywheel 25 to shift away from the rearward flywheel 24 to its inoperative position. At the same time, the nose portions of the Plates 72 and 80 affixed to bearing housing 55 and 56, respectively will contact return linkage arms 245*b* and 255*b* causing the return linkages to shift downwardly to their normal positions illustrated in FIGS. 4 and 5. With the return linkages so shifted, the driven return roller is urged forwardly by tension springs 266 and 268 so that the driver is firmly and frictionally engaged between driven return roller 206 and fixed return roller 207 and is driven rapidly upwardly by driven return roller 206 through its return stroke to its uppermost normal position in which it is locked by driver locking members 124 and 125.

The fastener driving tool of the present invention having been described in detail, its operation can now be set forth. The tool operator loads magazine 4 with a "stick" of nails. The feeder shoe 22 will urge the stick of nails forwardly and the forwardmost nail of the stick will be located in the drive track 3*a* of guide body 3. At this point, the tool is ready for use.

The operator connects the tool to a source of electrical current by means of electrical cord 21 and plug 21*a*. Grasping the tool 1 by its handle portion 6, the operator will actuate motor trigger 9 turning on motor 20 and initiating rotation of rearward flywheel 24, forward flywheel 25 and driven return roller 206.

At this point, the tool operator locates the lower end of guide body 3 on that part of a workpiece to be nailed. Slight pressure on the part of the operator will cause the safety 92 and the safety link 97 to shift upwardly to their retracted positions. As a result of the upward movement of safety 92 and safety link 97, four important occurrences take place within the tool 1. First of all, the upward movement of the safety link results in rotation of bearing housings 55 and 56 so that the forward flywheel 25 shifts to its operative position wherein its periphery is spaced from the periphery of the rearward flywheel 24 by a distance slightly less than the greatest nominal thickness of the driver 23. At the same time, the upper ends of safety 92 shift the left and right return linkages upwardly, resulting in a rearward movement of the driven return roller 206 and its return assembly 210, providing clearance between the driven return roller and fixed roller 207 such that the driver 23 can execute its workstroke without contacting driven return roller 206 or fixed roller 207.

Meanwhile, upward movement of the safety link 97 results in rotation of actuator lever 163. This shifts the actuator link 158 downwardly, compressing the actuator spring 161, thereby readying the actuator 151 for introducing the driver 23 in between the forward flywheel 25 and the rearward flywheel 24. Finally, upward movement of the safety link 97 pivots the trigger disabling link 194 and trigger stop 199 to an inoperative position so that the manual driver trigger 10 is now free to be actuated. The four last mentioned changes in tool 1, brought about by upward movement of safety 92 and safety link 97, occur quickly and substantially simultaneously.

At this stage, the tool operator is free to actuate manual driver trigger 10. This results in the disengagement of the driver locking members 24 and 25 from the driver shoulders 23*e* and 23*f*. The actuator 151 shoves downwardly on the upper end of driver 23 by virtue of spring 161. This introduces the driver 23 between flywheels 24 and 25, the flywheel 25 being in its operative position. In this manner, the driver 23 will be driven through a workstroke and will drive the forwardmost nail of the stick into the workpiece.

If the operator lifts the tool from the workpiece with the manual trigger still actuated, nothing will happen because the trigger disabling link 194 and trigger stop 199 will be precluded from returning to their normal positions by the manual driver trigger 10, itself. This, in turn, will prevent the safety link 97 and safety 92 from returning to their normal positions. If the operator releases the manual driver trigger 10 and then lifts the tool from the workpiece, the safety link 97 and the safety 92 will return to their normal, extended positions. As a result of this downward movement of the safety link 97 and safety 92, the trigger disabling link 194 and trigger stop 195 will shift to their inoperative positions. The safety link 97 will cause rotation of the bearing housings 55 and 56 in a clockwise direction as viewed in FIG. 5, shifting the forward flywheel 25 to its inoperative position with its periphery spaced from the periphery of the rearward flywheel 24 by a distance greater than the nominal thickness of driver 23. At the same time, the nose elements on the plates 72 and 80 will shift the left and right return linkages downwardly causing the driver at the end of its workstroke to be engaged between the driven return roller 206 and the stationary return roller 207 initiating the return stroke of driver 23. The above noted release of the manual driver trigger 10 will also shift the driver locking members 124 and 125 into position to engage the shoulders 23*e* and 23*f* of the driver when it reaches its normal, retracted position.

When the driver, during its return stroke, moves out of the drive track 3*a* of guide body 3, the feeder shoe 22 will assure that the next forwardmost nail of the stick will be located within the drive track 3*a*. At this point, the tool is in condition to repeat the nail driving sequence. Alternatively, the operator can release motor trigger 9 causing switch 9*a* to disconnect the motor 20 from the source of electrical current with the result that the flywheels 24 and 25 and the driven return roller will stop rotating.

In the above description and in the claims to follow, the use of such words as "up," "down," "forward," "rearward," "vertical," "horizontal," and the like, is in conjunction with the drawings for purposes of clarity. As will be understood by one skilled in the art, the tool can assume any orientation during use, depending upon the application to which it is directed.

Modifications may be made in the invention without departing from the spirit of it. For example, it would be within the scope of the present invention to replace the forward flywheel with a support means such as an unpowered, low inertia roller. While not required, such a low inertia roller would preferably be equal in diameter to the rearward flywheel 24. If, for example, the element 25 in FIG. 8 were to be considered to be a low inertia roller, it would only be necessary to remove gear 120 from rearward flywheel shaft 28 and gear 121 from shaft 34. The use of a driven flywheel and a low inertia roller is taught, for example, in U.S. Pat. No. 4,189,080.

What is claimed is:

1. An electromechanical fastener driving tool comprising a frame, a tool housing, a guide body and a magazine supported on said frame, a driver located within said frame and shiftable between a normal retracted position and an extended fastener driving position, a first rearward flywheel and a second forward flywheel being located within said frame and having peripheral surfaces, portions of which face each other, said first and second flywheels each having its own shaft, a pair of plate-like load springs in parallel spaced relationship being located exteriorly of said frame, said load springs having first ends, bearings mounted in said first ends of said load springs and being rotatively mounted in coaxial holes in said frame, said first flywheel being located between said load spring with its shaft being rotatively mounted in said load spring bearings, said load springs having second ends, and a pair of eccentric bearing housings each being mounted in a hole in said second end of each of said load springs, each bearing housing being partially received within notches in said frame, said second flywheel being located between said load springs with its shaft rotatively mounted in said load spring eccentric bearing housings, a bracket joining said bearing housings together, said bearing housings being simultaneously rotatable in their respective load spring holes to shift said second flywheel between an inoperative position wherein its peripheral surface is separated from said peripheral surface of said first flywheel by a distance greater than the thickness of said driver, and an operative position wherein said peripheral surface of said second flywheel is spaced from said peripheral surface of said first flywheel by a distance slightly less than the thickness of said driver, means to cause counter rotation of said flywheels irrespective of the position of said second flywheel, means to rotate said bearing housings and shift said second flywheel to its operative position, means to introduce said driver into engagement between said flywheels when said second flywheel is in its operative position to shift said driver through a work stroke, said load springs permitting said second flywheel to yield slightly to accommodate said driver, means to rotate said bearing housings to shift said second flywheel to its inoperative position at the end of said driven work stroke, and means to return said driver to its normal retracted position.

2. The tool claimed in claim 1 including an electric motor, an electrical circuit connecting said motor to a source of electric current, a trigger-actuated on/off switch for said motor in said circuit, said motor having a shaft, a gear train comprising a motor gear mounted on said motor shaft, first and second gears mounted on said first flywheel shaft and a flywheel gear mounted on said shaft of said second flywheel, said motor gear being meshed with said first gear of said first flywheel shaft, said second gear of said first flywheel shaft being meshed with said flywheel gear of said second flywheel when said second flywheel is in either of its operative and inoperative positions, whereby said first and second flywheels rotate in opposite directions directed to shift said driver through a work stroke whenever said trigger actuated motor switch is in its on mode.

3. The tool claimed in claim 2 including a manual driver trigger shiftable between an unactuated position and an actuated position to actuate said means to introduce said driver into engagement between said flywheels when said second flywheel is in its operative position, said on/off motor switch trigger being spring biased to its off position, said driver trigger being spring biased to its unactuated position, an extension on said on/off motor switch trigger terminating in an abutment surface, an extension on said driver trigger terminating in an abutment surface, said two abutment surfaces being opposed when said on/off motor switch trigger is in its off position and said driver trigger is in its unactuated position precluding movement of said driver trigger to its actuated position until said on/off motor switch trigger has first been shifted to its on position.

4. The tool claimed in claim 2 wherein said electrical circuit includes a variable speed control for said electric motor.

5. The tool claimed in claim 1 wherein said driver comprises a blade-like member of uniform thickness and uniform with opposite sides each facing the peripheral surface of one of said first and second flywheels and opposite edges, said driver having a lower driving end and an enlarged upper end, said driver being free floating, means to guide said driver between its normal retracted position and its extended fastener driven position, a portion of said driver near said driving end thereof lying between said first and second flywheels when said driver is in its normal retracted position, said driver portion having opposed notches formed in each driver side reducing the uniform thickness of said driver to maintain it out of contact with said flywheels when said second flywheel is in its operative position and said driver is in its normal retracted position, the upper end of each notch terminating in a tapered ramp to said full uniform driver thickness, locking means to lock said driver in its normal retracted position, a pivotally mounted driver trigger manually shiftable between actuated and unactuated positions, said driver trigger being engageable with said locking means to unlock said locking means to release said driver when said driver trigger is shifted to its actuated position, and said means to introduce said driver into engagement with said flywheels urging said uniform thickness portion of said driver above and adjacent said driver ramps between said first and second flywheels when said second flywheel is in its operative position and when said driver locking means has been unlocked by said driver trigger.

6. The tool claimed in claim 5 including a workpiece responsive safety, said safety comprising a U-shaped wire-like member having a workpiece contacting base portion and a pair of upstanding legs, said legs of said workpiece responsive safety being mounted in said frame for movement of said safety between a normal, extended, unactuated position and a retracted, actuated position, an elongated safety link having an end pivotally connected to an end of one of said legs of said work responsive safety and shiftable therewith to form a safety/safety link assembly, means to bias said safety/safety link assembly to its unactuated position, means connected to said safety/safety link assembly preventing actuation of said driver trigger until said safety/safety link assembly is first shifted to its actuated position.

7. The tool claimed in claim 5 including a workpiece responsive safety, said workpiece responsive safety comprising a U-shaped wire-like member having a workpiece contacting base portion and a pair of upstanding legs, said legs of said workpiece responsive safety being mounted on said frame for movement between a normal, extended, unactuated position and a retracted, actuated position, on of said legs of said workpiece responsive safety having a free end pivotally connected to a safety link which is shiftable with said workpiece responsive safety between said unactuated position and said actuated position to form a safety/-safety link assembly, means to bias said safety/safety link assembly to said unactuated position, a driver trigger disabling link, said safety link having a free upper end pivoted to one end of said driver trigger disabling link, the other end of said driver trigger disabling link being pivoted between and to said frame and to a driver trigger stop, said driver trigger stop terminating in an abutment surface, said driver trigger having a cooperating abutment surface, said driver trigger disabling link and said driver trigger stop being so positioned, when said safety/safety link assembly is in its unactuated position, that said driver trigger stop abutment surface contacts said driver trigger abutment surface precluding shifting of said driver trigger to its actuated position, said driver trigger disabling link, said driver trigger stop and its abutment a surface being shifted out of the way of said driver trigger abutment surface enabling said driver trigger to be shifted to its actuated position when said safety/safety link assembly is shifted to its actuated position, whereby said tool is a restrictive sequential tool requiring said workpiece responsive safety to be shifted to its actuated position before said driver trigger can be shifted to its actuated position.

8. The tool claimed in claim 5 wherein said driver has a pair of oppositely directed lateral extensions from its edges at its upper end, said extensions having lower edges defining shoulders, said driver locking means comprising a pair of elongated locking member each pivotally mounted at one end and having a free end engageable with one of said driver shoulders to lock said driver in its normal retracted position, said locking members being pivotable between a driver lock position and a driver release position, spring means biasing said locking members to their driver lock position, means biasing said driver trigger to its unactuated position, a nose on said driver trigger engageable with said locking members to shift said locking members to their driver release position when said driver trigger is shifted to its actuated position.

9. The tool claimed in claim 1 wherein said driver return means for shifting said driver through a return stroke comprises an idler roller fixedly mounted beneath said second flywheel and a driven return roller shiftable between an inoperative position spaced from said idler roller by a distance greater than the uniform thickness of said driver and an operative position wherein said driven return roller at the end of a work stroke engages said driver between itself and said idler roller imparting return motion to said driver, said return roller is driven in the proper direction of rotation by a gear train, said gear train and said driven roller are mounted on a gear frame, said gear frame is mounted by a pair of parallel spaced hangers each rotatably mounted on said frame, said hangers and said gear frame are rotatable between the operative and inoperative positions of said driven roller about the axis of said first flywheel shaft, said return roller gear train having a gear meshed with and driven by a gear mounted on said first flywheel shaft so that said return roller is driven whenever said flywheels are driven, means biasing said driven return roller and its gear train and gear frame to the operative position of said return roller, and means to shift said return roller and its gear train and gear frame to its inoperative position during a work stroke of said driver.

10. The tool claimed in claim 9 including a workpiece responsive safety, said safety comprising a U-shaped wire-like member having a workpiece contacting base portion and a pair of upstanding legs, said legs of said workpiece responsive safety being mounted in said frame for movement of said workpiece responsive safety between a normal, extended, unactuated position and a retracted, actuated position, an elongated safety link having an end pivotally connected to an end of one of said safety legs and shiftable therewith to form a safety/safety link assembly, means to bias said safety/-safety link assembly to its unactuated position, means operatively connecting said safety link to said eccentric bearing housings to shift said second flywheel to its operative position when said safety/safety link is in its actuated position and to its inoperative position when said safety/safety link assembly is in its unactuated position, a pair of mirror image, over-center, return link assemblies, one end of each return link assembly being pivotally connected to said return gear frame, the other end of each return link assembly being pivotally affixed to said frame, each return link assembly being shiftable between a first over-center position wherein said return gear frame and said driver return roller are in their operative position and a second over-center position wherein said gear frame and said driver return roller are in their inoperative position, said workpiece responsive safety having free ends being positioned to engage and shift said return link assemblies from their first to their second positions when said safety/safety link assembly is shifted to its actuated position and during a work stroke of said driver, each of said eccentric bearing housings supporting a plate with a laterally extending nose, said noses being so positioned as to engage and shift said return link assemblies from their second to their first positions when said safety/safety link assembly is shifted from its actuated to its unactuated position and said second flywheel is shifted to its operative position.

11. The tool claimed in claim 1 wherein said means to introduce said driver into engagement between said flywheels comprises a driver actuator having a hollow cylindrical body with upper and lower ends, said driver actuator body having a laterally extending arm which overlies the upper end of the driver when said driver is in its normal retracted position, a compression spring within said driver actuator body, means to compress said driver actuator spring toward said lower end of said driver actuator body to urge said driver actuator arm against the upper end of said driver to introduce said driver into engagement with said first and second flywheels when said second flywheel is in its operative position and upon initiation of a work stroke.

12. The tool claimed in claim 11 including a workpiece responsive safety, said workpiece responsive safety comprising a U-shaped wire-like member having a workpiece contacting base portion and a pair of upstanding legs, said legs of said workpiece responsive safety being mounted in said frame for movement of said safety between a normal, extended, unactuated position and a retracted, actuated position, an elongated safety link having an end pivotally connected to an end of one of said safety legs and shiftable therewith to form a safety/safety link assembly, means to bias said safety/-safety link assembly to its unactuated position, a link, said link having one end operatively connected to the upper end of said driver actuator spring, said link extending downwardly through said spring and an opening in said lower end of said driver actuator body, a lever, said lever having first and second free ends and a central portion pivoted to said frame, said link having a lower end pivoted to said first free end of said lever, said second free end of said lever being pivoted to said safety link such that when said safety/safety link assembly is shifted to its actuated position, said lever and link shift to compress said driver actuator spring.

13. The tool claimed in claim 1 including a lower stop of resilient material to absorb energy of the driver remaining after the work stroke, said stop comprising a body of resilient material located beneath said flywheels, said driver being blade like and uniform width terminating at one end in a driving surface and at the other end in an enlarged portion, said stop body having a slot therein through which said driver travels during a work stroke, said slot being of a length greater that said uniform width of said blade-like driver and less than said driver enlarged end whereby said lower stop is abutted by said enlarged driver end at the end of a work stroke.

14. The tool claimed in claim 1 including a workpiece responsive safety, said workpiece responsive safety comprising a U-shaped wire-like member having a workpiece contacting base portion and a pair of upstanding legs, said legs of said workpiece responsive safety being mounted in said frame for movement of said workpiece responsive safety between a normal, extended, unactuated position and a retracted, actuated position, an elongated safety link having an end pivotally connected to an end of one of said legs of said workpiece responsive safety and shiftable therewith to form a safety/safety link assembly, means to bias said safety/safety link assembly to its unactuated position, means operatively connecting said safety link to said eccentric bearing housings to shift said second flywheel to its operative position when said safety/safety link is in its actuated position and to its inoperative position when said safety/safety link assembly is in its unactuated position, said driver return means comprising a powered return roller and an idler roller, means actuable by said safety/safety link assembly to shift said powered return roller away from said idler roller by a distance greater than the uniform thickness of said driver when said safety/safety link is in its actuated position and during a driving stroke, means actuable by said safety/safety link assembly to shift said powered return roller toward said idler roller and engage said driver therebetween to initiate a return stroke at the end of a drive stroke when said safety/safety link assembly is shifted to its unactuated position, means for locking said driver in its normal retracted position following a return stroke, a manual driver trigger operatively connected to said locking means to release said driver when said driver trigger is actuated, means connected to said safety/safety link assembly preventing actuation of said driver trigger until said safety/safety link assembly is first shifted to its actuated position, said means to introduce said driver into engagement between said flywheels when said second flywheel is in its operative position comprises an actuator driven by a compressed compression spring upon actuation of said driver trigger, means operatively connecting said safety/safety link assembly to said compression spring to compress said spring upon shifting of said safety/safety link assembly to its actuated position and before actuation of said driver trigger.

15. The tool claimed in claim 1 including a workpiece responsive safety, said workpiece responsive safety comprising a U-shaped wire-like member having a workpiece contacting base portion and pair of upstanding legs, said legs of said workpiece responsive safety being mounted on said frame for movement between a normal, extended, unactuated position and a retracted, actuated position, one of said safety legs having a free end pivotally connected to a safety link which is shiftable with said workpiece responsive safety between said unactuated position and said actuated position and which forms a safety/safety link assembly therewith, means to bias said safety/safety link assembly to said unactuated position, said safety link being operatively attached to one of said bearing housings, said safety link being configured to rotate said bearing housings to shift said second flywheel to its operative position as said safety/safety link assembly is shifted to its actuated position, and to rotate said bearing housings to shift said second flywheel to its inoperative position as said safety/safety link assembly is shifted to its unactuated position.

16. The tool claimed in claim 1 wherein said tool housing has a forward end, a rearward end and sides, said guide body being located beneath said forward end of said housing, said magazine extending beneath said housing from said guide body toward said housing rearward end, said first and second flywheels being located in tandem one behind the other within said frame and said housing with their shafts extending transversely of said frame and said housing.

17. The tool claimed in claim 16 including an electric motor, an electrical circuit connecting said motor to a source of electric current, a trigger-actuated on/off switch for said motor in said circuit, said motor having a shaft, a gear train comprising a motor gear mounted on said motor shaft, first and second gears mounted on said first flywheel shaft and a flywheel gear mounted on said shaft of said second flywheel, said motor gear being meshed with said first gear of said first flywheel shaft, said second gear of said first flywheel shaft being meshed with said flywheel gear of said second flywheel when said second flywheel is in either of its operative and inoperative positions, whereby said first and second flywheels rotate in opposite directions directed to shift said driver through a work stroke whenever said trigger actuated motor switch is in said on mode.

18. The tool claimed in claim 17 wherein said driver comprises a blade-like member of uniform thickness and uniform width with opposite sides each facing the peripheral surface of one of said first and second flywheels and opposite edges, said driver having a lower driving end and an enlarged upper end, said driver being free floating, means to guide said driver between its normal retracted position and its extended fastener driven position, a portion of said driver near said driving end thereof lying between said first and second flywheels when said driver is in its normal retracted position, said driver portion having opposed notches formed in each driver side reducing the nominal thickness of said driver to maintain it out of contact with said flywheels when said second flywheel is in its operative position and said driver is in its normal retracted position, the upper end of each notch terminating in a tapered ramp to said full uniform driver thickness, locking means to lock said driver in its normal retracted position, a pivotally mounted driver trigger manually shiftable between actuated and unactuated positions, said driver trigger being engageable with said locking means to unlock said locking means to release said driver when said driver trigger is shifted to its actuated position, and said means to introduce said driver into engagement with said flywheels urging said uniform thickness portion of said driver above and adjacent said driver ramps between said first and second flywheels when said second flywheel is in its operative position and when said driver locking means has been unlocked by said driver trigger.

19. The tool claimed in claim 18 wherein said driver return means for shifting said driver through a return stroke comprises an idler roller fixedly mounted beneath said second flywheel and a driven return roller shiftable between an inoperative position spaced from said idler roller by a distance greater than the uniform thickness of said driver and an operative position wherein said driven return roller at the end of a work stroke engages said driver between itself and said idler roller imparting return motion to said driver, said return roller is driven in the proper direction of rotation by a gear train, said gear train and said driven roller are mounted on a gear frame, said gear frame is mounted by a pair of parallel spaced hangers each rotatably mounted on said frame, said hangers and said gear frame are rotatable between the operative and inoperative positions of said driven roller about the axis of said first flywheel shaft, said return roller gear train having a gear meshed with and driven by a gear mounted on said first flywheel shaft so that said return roller is driven whenever said flywheels are driven, means biasing said driven return roller and its gear train and gear frame to the operative position of said return roller, and means to shift said return roller and its gear train and gear frame to its inoperative position during a work stroke of said driver.

20. The tool claimed in claim 19 wherein said means to introduce said driver into engagement between said flywheels comprises a driver actuator having a hollow cylindrical body with upper and lower ends, said driver actuator body having a laterally extending arm which overlies the upper end of the driver when said driver is in its normal retracted position, a compression spring within said driver actuator body, means to compress said driver actuator spring toward said lower end of said driver actuator body to urge said driver actuator arm against the upper end of said driver to introduce said driver into engagement with said first and second flywheels when said second flywheel is in its operative position and upon initiation of a work stroke.

21. The tool claimed in claim 20 including a workpiece responsive safety, said workpiece responsive safety comprising a U-shaped wire-like member having a workpiece contacting base portion and a pair of upstanding legs, said legs of said workpiece responsive safety being mounted on said frame for movement between a normal, extended, unactuated position and a retracted, actuated position, one of said workpiece responsive safety legs having a free end pivotally connected to a safety link which is shiftable with said safety between said unactuated position and said actuated position and which forms a safety/safety link assembly therewith, means to bias said safety/safety link assembly to said unactuated position, said safety link being operatively attached to one of said bearing housings, said safety link being configured to rotate said bearing housing to shift said second flywheel to its operative position as said safety/safety link assembly is shifted to its actuated position, and to rotate said bearing housings to shift said second flywheel to its inoperative position as said safety/safety link assembly is shifted to its unactuated position, a driver trigger disabling link having ends, said safety link having a free upper end pivoted to one end of said driver trigger disabling link, the other end of said driver trigger disabling link being pivoted to said frame and to a driver trigger stop, said driver trigger stop terminating in an abutment surface, said driver trigger having a cooperating abutment surface, said driver trigger disabling link and said driver trigger stop being so positioned, when said safety/safety link assembly is in its unactuated position, that said driver trigger stop abutment surface contacts said driver trigger abutment surface precluding shifting of said driver trigger to its actuated position, said driver trigger disabling link, said driver trigger stop and its abutment surface being shifted out of the way of said driver trigger abutment surface enabling said driver trigger to be shifted to its actuated position when said safety/safety link assembly is shifted to its actuated position, a pair of mirror image, over-center, return link assemblies having ends, one end of each return link assembly being pivotally connected to said return gear frame, the other end of each return link assembly being pivotally affixed to said tool frame, each return link assembly being shiftable between a first over-center position wherein said return gear frame and said driver return roller are in their operative position and a second over-center position wherein said gear frame and said driver return roller are in their inoperative position, the free ends of said safety being positioned to engage and shift said return link assemblies from their first to their second positions when said safety/safety link assembly is shifted to its actuated position and during a work stroke of said driver, each of said eccentric bearing housings supporting a plate with a laterally extending nose, said noses being so positioned as to engage and shift said return link assemblies from their second to their first positions when said safety/-safety link assembly is shifted from its actuated to its unactuated position and said forward flywheel is shifted to its inoperative position, a link, said link having one end operatively connected to the upper end of said driver actuator spring, said link extending downwardly through said spring and an opening in said lower end of said driver actuator body, a lever, said lever having first and second free ends and a central portion pivoted to said tool frame, said link having a lower end pivoted to said first free end of said lever, said second free end of said lever being pivoted to said safety link such that when said safety/safety link assembly is shifted to its actuated position, said lever and link shift to compress said driver actuator spring.

22. The tool claimed in claim 21 wherein said driver trigger is spring biased to its unactuated position, an extension on said on/off motor switch trigger terminating in an abutment surface, an extension on said driver trigger terminating in an abutment surface, said two abutment surfaces being opposed when said on/off motor switch trigger is in its off position and said driver trigger is in its unactuated position precluding movement of said driver trigger to its actuated position until said on/off motor switch trigger has first been shifted to its on position.

23. An electromechanical fastener driving tool comprising a tool housing, a guide body, a magazine and a driver of uniform thickness shiftable between a normal retracted position and an extended fastener driven position, a driven first flywheel and a support means, said first driven flywheel and said support means having facing peripheral surface portions and each having its own shaft, a pair of arcuate, plate-like load springs, means for mounting said load springs in parallel spaced relationship in said tool housing, said load springs having first ends, bearings mounted in said load spring first ends, said first flywheel being located between said load springs with its shaft rotatively mounted in said load spring bearings, said load springs having second ends, an eccentric bearing housing being mounted in a hole in said second end of each of said load springs, said support means being located between said load springs with its shaft rotatively mounted in said eccentric bearing housings, said bearing housings being simultaneously rotatable in their respective load spring holes to shift said support means between an inoperative position wherein its peripheral surface is separated from said peripheral surface of said first flywheel by a distance greater than the uniform thickness of said driver, and an operative position wherein said peripheral surface of said support means is spaced form said peripheral surface of said first flywheel by a distance slightly less than the uniform thickness of said driver, means to rotate said bearing housings and shift said support means to its operative position, means to introduce said driver into engagement between said first flywheel and said support means when said support means is in its operative position to shift said driver through a work stroke, said load springs permitting said support means to yield slightly to accommodate said driver, means to rotate said bearing housing to shift said support means to its inoperative position at the end of said driver work stroke, and means to return said driver to its normal retracted position.

24. The fastener driving tool claimed in claim 23 wherein said support means comprises a second driven flywheel.

25. The fastener driving tool claimed in claim 23 wherein said support means comprises a non-driven low inertia roller.

26. The tool claimed in claim 23 wherein said tool housing has a forward end, a rearward end and sides, said guide body being located beneath said forward end of said housing, said magazine extending beneath said housing from said guide body toward said housing rearward end, said first flywheel and said support means being located in tandem one behind the other within said housing with their shafts extending transversely of said housing, said support means being forward of said first flywheel.

27. The tool claimed in claim 26 including a frame, said tool housing, said guide body, and said magazine being supported on said frame, said first flywheel and said support means being located within said frame, said load springs being located exteriorly and to either side of said frame, said load spring bearings being rotatively mounted in coaxial holes in said frame, and said eccentric bearing housings of said load springs each being partially received within notches in said frame.

28. The tool claimed in claim 26 wherein said support means comprises a second driven flywheel.

29. The tool claimed in claim 28 including an electric motor, an electrical circuit connecting said motor to a source of electric current, a trigger-actuated on/off switch for said motor in said circuit, said motor having a shaft, a gear train comprising a motor gear mounted on said motor shaft, first and second gears mounted on said first flywheel shaft and a flywheel gear mounted on said shaft of said second flywheel, said motor gear being meshed with said first gear of said first flywheel shaft, and said second gear of said first flywheel shaft being meshed with said flywheel gear of said second flywheel when said second flywheel is in either of its operative and inoperative positions, whereby said first and second flywheels rotate in opposite directions directed to shift said drive through a work stroke whenever said trigger actuated motor switch is in said on mode.

30. An electromechanical fastener driving tool comprising a tool housing, a guide body, a magazine and a driver of uniform thickness and uniform width shiftable between a normal retracted position and an extended fastener driven position, a first driven flywheel and a support means, said first driven flywheel and said support means having facing peripheral surface portions, means to shift said support means between an inoperative position wherein its peripheral surface is separated from said peripheral surface of said first flywheel by a distance greater than the uniform thickness of said driver, and an operative position wherein said peripheral surface of said support means is spaced from said peripheral surface of said first flywheel by a distance slightly less than the uniform thickness of said driver, said driver comprising a blade-like member with opposite sides each facing the peripheral surface of one of said first flywheel and said support means and opposite edges, said driver having a lower driving end and an upper end, said driver being free floating, means to guide said driver between its normal retracted position and its extended fastener driven position, a portion of said driver near said driving end thereof lying between said first flywheel and said support means when said driver is in its normal retracted position, said driver portion having opposed notches formed in each driver side reducing the uniform thickness of said driver to maintain it out of contact with said first flywheel and said support means when said support means is in its operative position and said driver is in its normal retracted position, the upper end of each notch terminating in a tapered ramp to said full uniform driver thickness, means to introduce said driver into engagement between said first flywheel and said support means, when said support means is in its operative position to shift said driver through a work stroke, and means permitting said support means to yield slightly to accommodate said driver.

31. The fastener driving tool claimed in claim 30 wherein said support means comprises a second driven flywheel.

32. The fastener driving tool claimed in claim 30 wherein said support means comprises a non-driven low inertial roller.

33. An electromechanical fastener driving tool comprising a tool housing, a guide body, a magazine and a driver of uniform thickness shiftable between a normal retracted position and an extended fastener driven position, a first driven flywheel and a support means, said first driven flywheel and said support means having facing peripheral surface portions, means to shift said support means between an inoperative position wherein its peripheral surface is separated from said peripheral surface of said first flywheel by a distance greater than the uniform thickness of said driver, and an operative position wherein said peripheral surface of said support means is spaced from said peripheral surface of said first flywheel by a distance slightly less than the uniform thickness of said driver, said driver comprising a blade-like member having a lower driving end and an upper end, means to introduce said driver into engagement between said first flywheel and said support means, when said support means is in its operative position to shift said driver through a work stroke, means permitting said support means to yield slightly to accommodate said driver, means to return said driver to its normal retracted position after said work stroke, means to lock said driver in its normal retracted position and a driver trigger to release said driver from said locking means for the next work stroke.

34. The fastener driving tool claimed in claim 33 wherein said support means comprises a second driven flywheel.

35. The fastener driving tool claimed in claim 33 wherein said support means comprises a non-driven low inertia roller.

36. The tool claimed in claim 33 including a pair of oppositely directed lateral extensions on said driver at its upper end, said extensions having lower edges defining shoulders, said driver locking means comprising a pair of elongated locking members each pivotally mounted at one end and having a free end engageable with one of said driver shoulders to lock said driver in its normal retracted position, said locking members being pivotable between a driver lock position and a driver release position, spring means biasing said locking members to their driver lock position, said driver trigger being pivotally mounted and manually shiftable between actuated and unactuated positions, means biasing said driver trigger to its unactuated position, a nose on said driver trigger engageable with said locking members to shift said locking members to their driver release position when said driver trigger is shifted to its actuated position.

37. An electromechanical fastener driving tool comprising a tool housing, a guide body, a magazine and a driver of uniform thickness shiftable between a normal retracted position and an extended fastener driven position, a first driven flywheel having a shaft and an axis of rotation and a support means, said first driven flywheel and said support means having facing peripheral surface portions, means to shift said support means between an inoperative position wherein its peripheral surface is separated from said peripheral surface of said first flywheel by a distance greater than the uniform thickness of said driver, and an operative position wherein said peripheral surface of said support means is spaced from said first flywheel by a distance slightly less than the uniform thickness of said driver, said driver being free floating, means to guide said driver between its normal retracted position and its extended fastener driven position, means to introduce said driver into engagement between said first flywheel and said support means, when said support means is in its operative position to shift said driver through a work stroke, and means permitting said support means to yield slightly to accommodate said driver, means to return said driver to its normal retracted position at the end of a work stroke and with said support means in its inoperative position, said driver return means comprising an idler roller fixedly mounted beneath said support means and a driven return roller shiftable between an inoperative position spaced from said idler roller by a distance greater than the uniform thickness of said driver and an operative position wherein said driven return roller at the end of a work stroke engages said driver between itself and said idler roller imparting return motion to said driver, said return roller is driven in the proper direction of rotation by a gear train, said gear train and said driven roller are mounted on a gear frame, and gear frame is mounted by a pair of hangers rotatable between the operative and inoperative positions of said driven roller about an axis which is coaxial with the axis of said first flywheel shaft, said return roller gear train having a gear meshed with and driven by a gear mounted on said first flywheel shaft so that said return roller is driven whenever said first flywheel is driven, means biasing said driven return roller and its gear train and gear frame to the operative position of said return roller, and means to shift said return roller and its gear train and gear frame to its inoperative position during a work stroke of said driver.

38. The fastener driving tool claimed in claim 37 wherein said support means comprises a second driven flywheel.

39. The fastener driving tool claimed in claim 37 wherein said support means comprises a non-driven low inertia roller.

* * * * *